US010844336B2

(12) United States Patent
Brouwers et al.

(10) Patent No.: US 10,844,336 B2
(45) Date of Patent: Nov. 24, 2020

(54) CLEANING PRODUCT COMPRISING AN INVERTED CONTAINER ASSEMBLY AND A VISCOUS CLEANING COMPOSITION

(71) Applicant: The Procter & Gamble Company, Cincinnati, OH (US)

(72) Inventors: Katrien Brouwers, Lennik (BE); Karl Ghislain Braeckman, Gerpinnes (BE); Robby Renilde Francois Keuleers, Lippelo (BE); Deepak Ahirwal, Brussels (BE); Greta Annie Renata Sanders, Boortmeerbeek (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 16/244,535

(22) Filed: Jan. 10, 2019

(65) Prior Publication Data

US 2019/0218484 A1 Jul. 18, 2019

(30) Foreign Application Priority Data

Jan. 16, 2018 (EP) ..... 18151770

(51) Int. Cl.

| | |
|---|---|
| ***C11D 1/02*** | (2006.01) |
| ***C11D 1/12*** | (2006.01) |
| ***C11D 1/72*** | (2006.01) |
| ***C11D 1/722*** | (2006.01) |
| ***C11D 1/83*** | (2006.01) |

(Continued)

(52) U.S. Cl.

CPC ..... *C11D 17/041* (2013.01); *A47K 5/122* (2013.01); *B65D 47/2018* (2013.01); *B65D 47/2031* (2013.01); *B65D 51/249* (2013.01); *B65D 85/70* (2013.01); *C11D 1/83* (2013.01); *C11D 1/94* (2013.01); *C11D 3/3707* (2013.01); *C11D 3/3723* (2013.01); *C11D 1/146* (2013.01);

(Continued)

(58) Field of Classification Search

CPC .... C11D 1/02; C11D 1/12; C11D 1/72; C11D 1/722; C11D 1/83; C11D 1/88; C11D 1/90; C11D 1/94; C11D 3/30; C11D 3/3707; C11D 3/3723; B08B 3/04; B65D 47/2031; B65D 47/472018; B65D 51/249; B65D 47/2018

See application file for complete search history.

(56) References Cited

U.S. PATENT DOCUMENTS

2007/0275868 A1* 11/2007 Cooremans ..... C11D 3/3723 510/475
2016/0201014 A1* 7/2016 Perez-Garcia ..... C11D 3/201 510/237

FOREIGN PATENT DOCUMENTS

JP 2007176594 A 12/2005
WO WO00/68038 A1 11/2000

(Continued)

OTHER PUBLICATIONS

Co-Pending Application—filed concurrently on Jan. 10, 2019, 38 pages.

*Primary Examiner* — Brian P Mruk
(74) *Attorney, Agent, or Firm* — Melissa Krasovec

(57) ABSTRACT

The invention relates to a cleaning product including an inverted container assembly comprising an inverted container and a liquid dispenser attached to a bottom surface of the inverted container, and a viscous cleaning composition contained in the inverted container assembly. The present invention also relates to the use of the cleaning product for cleaning dishware.

18 Claims, 9 Drawing Sheets

(51) Int. Cl.

| | |
|---|---|
| ***C11D 1/88*** | (2006.01) |
| ***C11D 1/90*** | (2006.01) |
| ***C11D 1/94*** | (2006.01) |
| ***C11D 3/30*** | (2006.01) |
| ***C11D 3/37*** | (2006.01) |
| ***B08B 3/04*** | (2006.01) |
| ***B65D 47/20*** | (2006.01) |
| ***C11D 17/04*** | (2006.01) |
| ***A47K 5/122*** | (2006.01) |
| ***B65D 51/24*** | (2006.01) |
| ***B65D 85/00*** | (2006.01) |
| *C11D 1/14* | (2006.01) |
| *C11D 1/75* | (2006.01) |
| *C11D 1/29* | (2006.01) |
| *C11D 11/00* | (2006.01) |

(52) U.S. Cl.
CPC ..... *C11D 1/29* (2013.01); *C11D 1/75* (2013.01); *C11D 11/0023* (2013.01)

(56) References Cited

FOREIGN PATENT DOCUMENTS

| | | | |
|---|---|---|---|
| WO | WO2004/002843 | A1 | 1/2004 |
| WO | WO2009/156317 | A1 | 12/2009 |
| WO | WO2010/028941 | A1 | 3/2010 |
| WO | WO2010/066585 | A1 | 6/2010 |
| WO | WO2010/069799 | A1 | 6/2010 |
| WO | WO2010/072529 | A1 | 7/2010 |

* cited by examiner

CLEANING PRODUCT COMPRISING AN INVERTED CONTAINER ASSEMBLY AND A VISCOUS CLEANING COMPOSITION

FIELD OF THE INVENTION

The present invention relates to a cleaning product comprising an inverted container assembly and a liquid hand dishwashing cleaning composition having a specific surfactant system to substantially reduce/prevent undesirable liquid leakage caused by transient liquid pressure increases (e.g., hydraulic hammer pressure) and/or substantially improve liquid stringing reduction/prevention upon dosing.

BACKGROUND OF THE INVENTION

Inverted containers are containers that include an opening at the "bottom" for dispensing the liquid detergent contained inside. Typically, the consumer squeezes the sides of the inverted container to dispense the liquid detergent. The use of inverted containers to package consumer goods has become more popular, particularly in the field of liquid hand dishwashing cleaning products. Consumers prefer inverted containers because they are ergonomically easy to operate. For instance, inverted containers do not require constant twisting of the wrist to dose liquid detergents, unlike with traditional upright containers, which can be uncomfortable or difficult on the consumers, especially with larger sized bottles and/or for the elderly consumers. Furthermore an inverted container also facilitates dosing till the last drop, which is more challenging with a traditional upright container having the opening at the "top". The terms "bottom" and "top" are to be interpreted according to how the container is intended to be positioned upon storage, i.e., when not in use. For example, an inverted container includes the opening at the bottom and the upright container includes the opening at the top when the containers are stored. An additional benefit of inverted container is minimized risk of perfume and/or solvent evaporation when left open, thereby positively impacting physical stability and/or perfume longevity accordingly. The inverted container also avoids the exterior air from mixing with liquid detergent to be dosed upon container rotation which could eventually lead to splashing upon "air" dosing.

A particular challenge for inverted containers is leakage prevention, especially when the inverted container does not comprise a closing cap. The term "closing cap" as used herein means a physical block (i.e., a solid member) that blocks the bottle exit such that the consumer would have to physically remove/displace the solid member to allow the liquid being dosed to exit through the bottom opening. An example of a closing cap is a flip-top cap moveable between a closed and open position. A skilled person in the art will know of other possible closing caps. It will be understood that the following items are not considered to be a "closing cap": one or two-way valves or a baffle located at the bottle exit, or a strip applied to prevent leakage during transport and to be removed prior to first usage.

The absence of a closing cap is preferred by consumers in order to keep the dosing operation a single-handed operation as no need to open/close the cap with a second hand, as well as speeding up the dosing operation since less steps are needed. There is a tendency for the liquid housed inside the inverted container to leak out during steady state (i.e., storage) and/or upon impact, especially upon impact. For example, leakage may occur during storage when the inverted container is subjected to a temperature change, specifically increase (e.g., inverted container placed beside sunny window or near stove top, etc.), that can lead to internal pressure increases and leakage. Specifically, by "impact" it is meant that when the inverted container is handled, transported, dropped or knocked over. As a result of the impact, transient liquid pressure, also referred to as hydraulic hammer pressure, increases inside the inverted container and can cause leakage through the opening at the bottom.

Previous attempts to address the leakage problem have involved incorporating a resilient valve into the opening (see for example WO2004/02843 (Method Products)). However, it has been observed that even with the resilient valve leakage to some degree may still occur. Other attempts have incorporated baffles on top of the resilient valve (see for example JP2007/176594 (Lion) and WO2000/6038 (Aptar Group)), which have not completely resolved the leakage issue particularly as it pertains to inverted containers, more particularly upon impact. Yet other attempts have involved incorporating a flowable viscous (at least 500 Pa·s) laundry composition inside a compressible inverted container with a cap that functions as supportive base (see WO2009/156317 (Unilever)). None of these solutions fully addresses the problems discussed above.

This leakage problem is compounded by the fact that these marketed liquid dishwashing cleaning compositions are relatively highly viscous (i.e., >3,000 mPa·s), which makes dosing and especially dissolution of the compositions more challenging, and might limit the formulator in using technologies which make it challenging to reach such high product viscosities. It has also been observed that these compositions might tend to 'string' once the consumer stops dispensing (i.e., stops applying force to the sides of the inverted container) the liquid composition. 'Stringing' is the phenomenon wherein the liquid composition remains attached to the opening at the bottom of the inverted container and forms a 'capillary' between the opening at the bottom and the exterior environment. As a result of the stringing some of the liquid composition is left around and inside the opening at the bottom. This liquid composition tends to dry and forms a crust. If the crust is allowed to build-up, then it eventually blocks the opening. Alternatively the stringing liquid composition might drop under the influence of gravity upon storage and eventually damage a sensitive storage surface.

It is believed that the surfactant system of these marketed liquid dishwashing cleaning compositions contributes to their highly viscous profile and leads to the observed leakage and/or stringing.

Thus, the need remains for an improved cleaning product comprising an inverted container assembly and a liquid hand dishwashing cleaning composition contained therein. It is desirous that the specific surfactant system of the liquid composition helps to substantially reduce or prevent leakage of the liquid when the inverted container is impacted, particularly dropped or knocked over. It is also desirous that the specific surfactant system of the liquid composition helps to substantially reduce or prevent steady state leakage of the liquid from the inverted container. The need also exists for an improved cleaning product comprising an inverted container and a liquid composition having a specific surfactant system for substantially reducing or preventing stringing of the liquid composition, preferably upon dosing, more preferably when the dosing has completed. Preferably the product formulation approach also allows lower product viscosities in order to facilitate product dosing and dissolution properties. Faster product dissolution also leads to faster suds creation which connotes a product activation signal to the user. The Applicant discovered that some or all of the above-mentioned needs can be at least partially fulfilled through the improved cleaning product as described herein below.

SUMMARY OF THE INVENTION

The present invention meets one or more of these needs based on the surprising discovery that a cleaning product comprising an inverted container assembly and a cleaning composition having a surfactant system comprising an anionic surfactant and a primary co-surfactant system in a ratio of 8:1 to 1:1, such a cleaning product exhibits improved leakage and/or stringing prevention.

In one aspect, the present invention addresses these needs by providing a cleaning product comprising an inverted container assembly and a liquid hand dishwashing cleaning composition. The inverted container assembly comprises an inverted container having a bottom surface and a top surface located away from the bottom surface, wherein the bottom surface has an opening. A liquid dispenser is attached, preferably releasably attached, to the bottom surface of the inverted container. The liquid dispenser accommodates the dispensing of the cleaning composition from the bottom of the inverted container. The cleaning composition comprises from 1% to 60% by weight of the total composition of a surfactant comprising: i) an anionic surfactant, preferably the anionic surfactant is selected from the group consisting of alkyl sulfate, alkyl alkoxy sulfate and mixtures thereof, preferably wherein the alkyl alkoxy sulfate is an alkyl ethoxy sulfate; and ii) a primary co-surfactant system, wherein the primary co-surfactant system is selected from the group consisting of amphoteric surfactant, zwitterionic surfactant and mixtures thereof, preferably the primary co-surfactant system is an amphoteric surfactant preferably an amine oxide surfactant; wherein the composition comprises the anionic surfactant and the primary cosurfactant system is in a weight ratio of from 8:1 to 1:1, preferably 4:1 to 2:1, more preferably from 3.5:1 to 2.5:1. This specific surfactant system enables cleaning composition having a lower shear viscosity and effectively functions to substantially reduce or prevent leakage, particularly during impact, and/or prevent the likelihood of liquid stringing after dispensing has completed.

In another aspect, the present invention relates to a method of cleaning dishware with the cleaning product according to the claims, the method comprising the step of squeezing the inverted container to dispense the cleaning composition from the opening on the bottom surface.

In yet another aspect, the present invention relates to the use of a cleaning product according to the claims for substantially reducing or preventing leakage of the cleaning composition from the inverted container, preferably when the inverted container is subjected to a hydraulic hammer pressure.

In yet another aspect, the present invention relates to the use of a cleaning product according to the claims for substantially reducing or preventing stringing of the cleaning composition, preferably when dispensing has completed.

In yet another aspect, the present invention relates to a cleaning product comprising a liquid cleaning composition according to the invention and an inverted container assembly comprising an inverted container and a liquid dispenser attached, preferably releasably attached, to the inverted container as claimed. Preferably, the inverted container does not comprise a closing cap or seal.

One aim of the present invention is to provide a cleaning product as described herein having substantially improved leakage reduction and/or prevention when the inverted container is impacted, particularly dropped or knocked over, so that the cleaning composition does not leak out. Such an improved cleaning product would accommodate more rugged handling or abuse of the inverted container.

Another aim of the present invention is to provide a cleaning product as described herein which substantially reduces and/or prevents steady state leakage of the cleaning composition. It is advantageous that the cleaning composition does not leak out unless force is intentionally applied to the inverted container to dispense the liquid. This avoids messy dried liquid forming near the dispensing orifice, which can potentially block the liquid from being dispensed, or messiness in the storage area leading to eventual surface damage when stored on delicate surfaces.

A further aim of the present invention is to provide a cleaning product as described herein which substantially reduces and/or prevents liquid stringing after dispensing has completed, so that the cleaning composition does not dry and form crust around and inside the opening at the bottom of the inverted container. Such an improved cleaning product would avoid liquid messiness and dried up crust of liquid around the liquid dispenser to prevent problems with dispensing.

Yet a further aim of the present invention is to provide a cleaning product as described herein that allows for ease and accurate dosing without needing to turn the containers over. This is believed to contribute to faster and improved ergonomical dosing experience (i.e., more comfortable, less stress on the wrist, less strength needed, etc.).

Yet a further aim of the present invention is to provide a cleaning product as described herein that would allow access to every last drop of the liquid inside the inverted containers. Thus, it is an advantage of the invention to minimize waste.

Another advantage of the present invention is that it allows for use with larger sized inverted containers (e.g., >450 mL). It is expected that the improved cleaning product enables higher weight tolerances when used with larger inverted containers thereby substantially reducing/preventing liquid leakage.

These and other features, aspects and advantages of the present invention will become evident to those skilled in the art from the detailed description which follows.

BRIEF DESCRIPTION OF THE DRAWINGS

While the specification concludes with claims particularly pointing out and distinctly claiming the invention, it is believed that the invention will be better understood from the following description of the accompanying figures wherein like numerals are employed to designate like parts throughout the same:

DETAILED DESCRIPTION OF THE INVENTION

Figure 1A:
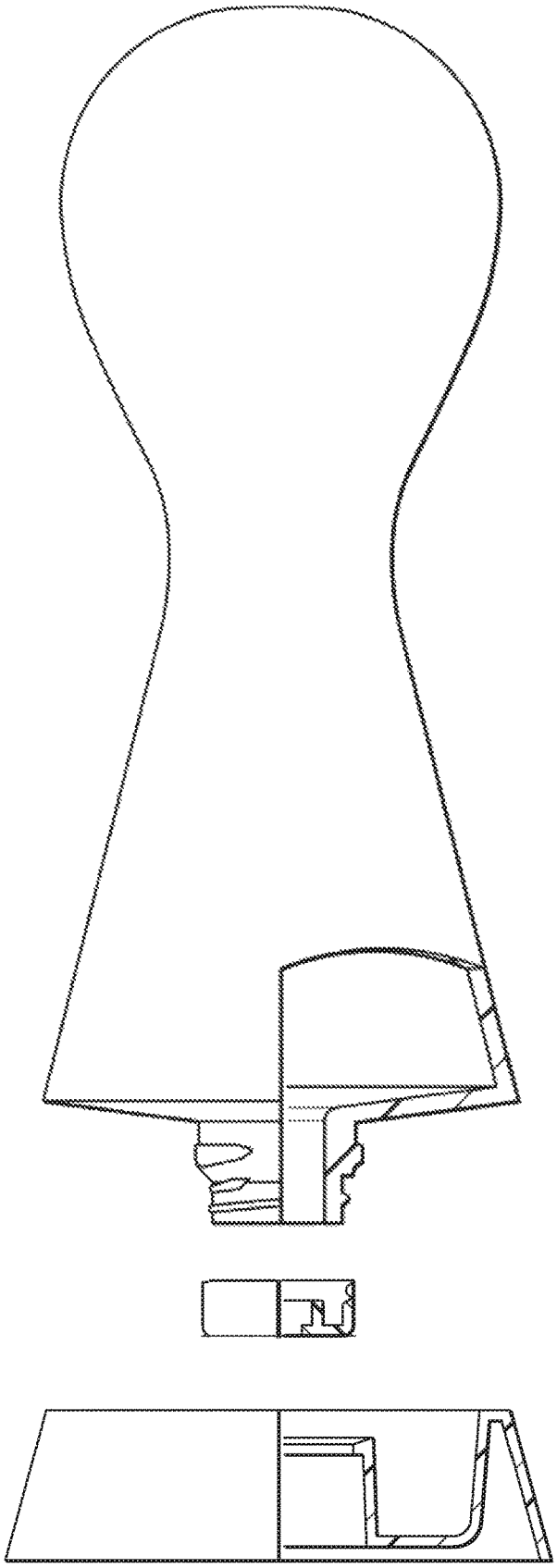
FIG. 1*a* shows a liquid dishwashing detergent packaged in an inverted container.
Figure 1B:
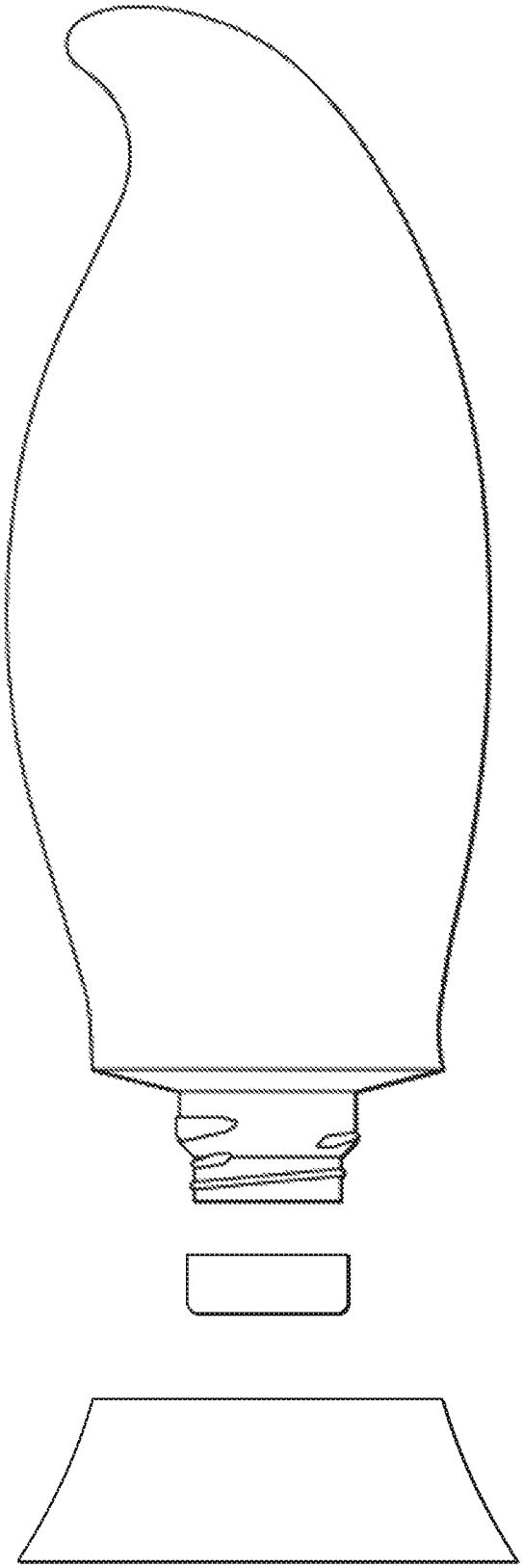
FIG. 1*b* shows a liquid dishwashing detergent packaged in an inverted container.

It is to be understood that the scope of the claims is not limited to the specific devices, apparatuses, methods, conditions or parameters described and/or shown herein, and that the terminology used herein is for the purpose of describing particular aspects of the invention by way of examples only and is not intended to be limiting of the claimed invention.

As used herein, articles such as "a" and "an" when used in a claim, are understood to mean one or more of what is claimed or described.

As used herein, any of the terms "comprising", "having", "containing", and "including" means that other steps, ingredients, elements, etc. which do not adversely affect the end result can be added. Each of these terms encompasses the terms "consisting of" and "consisting essentially of". Unless otherwise specifically stated, the elements and/or equipment herein are believed to be widely available from multiple suppliers and sources around the world.

As used herein, the term "compressible" means the ability of a substance to reduce volume under influence of increased pressure, in which the volume reduction is at least 1%, preferably at least 5%, most preferably at least 10%.

As used herein, the term "consumers" is meant to include the customers who purchase the product as well as the person who uses the cleaning product.

As used herein, the term "hydraulic hammer pressure" means a transient pressure increase caused when the liquid inside the inverted container (11) is forced to stop or change direction suddenly (i.e., momentum change) typically as a result of impact to the inverted container (11). Hydraulic hammer pressure can also be referred to as "impact force". If the hydraulic hammer pressure is not somehow absorbed by the liquid dispenser (15), then the force might (momentarily) open the valve and cause leakage of the liquid.

The terms "include", "includes" and "including" are meant to be non-limiting.

As used herein, the term "steady state" means the constant pressure properties of the liquid inside the inverted container (11) when it is at rest.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "1.2 cm" is intended to mean "about 1.2 cm".

It is understood that the test methods that are disclosed in the Test Methods Section of the present application must be used to determine the respective values of the parameters of Applicants' inventions as described and claimed herein.

In all embodiments of the present invention, all percentages are by weight of the total composition, as evident by the context, unless specifically stated otherwise. All ratios are weight ratios, unless specifically stated otherwise, and all measurements are made at 25° C., unless otherwise designated.

Cleaning Product

The Applicants have surprisingly discovered an improved cleaning product comprising an inverted container assembly (10) and a liquid dishwashing cleaning composition (100) to provide substantially improved leakage and liquid stringing reduction/prevention. Essentially, the solution is to formulate the cleaning composition (100) having a specific surfactant system comprising an anionic surfactant and a primary co-surfactant system, preferably an amphoteric surfactant, more preferably an amine oxide surfactant, and wherein the anionic surfactant and the primary co-surfactant system is in a weight ratio of from 8:1 to 1:1, preferably 4:1 to 2:1, more preferably from 3.5:1 to 2.5:1. In fact, the inventors have discovered that this specific surfactant system enables the cleaning composition (100) to have a lower shear viscosity profile (i.e., ≤10,000 mPa·s), which substantially reduces/prevents leakage upon impact of the inverted container (11) and/or stringing of the cleaning composition (100) upon dosing, preferably when the dosing has completed. While not wishing to be bound by theory, it is believed that the specific surfactant system in the cleaning composition (100) herein impacts the elastic properties of the liquid cleaning composition (100), and enables the composition to have high elasticity at low shear and as such rendering the product less sensitive to leakage upon storage or "hydraulic hammer" impact. The specific surfactant system also enables the composition to have low elasticity upon high shear and as such substantially reduce or prevent liquid stringing, preferably upon dosing, more preferably when dosing has completed.

Figure 2:
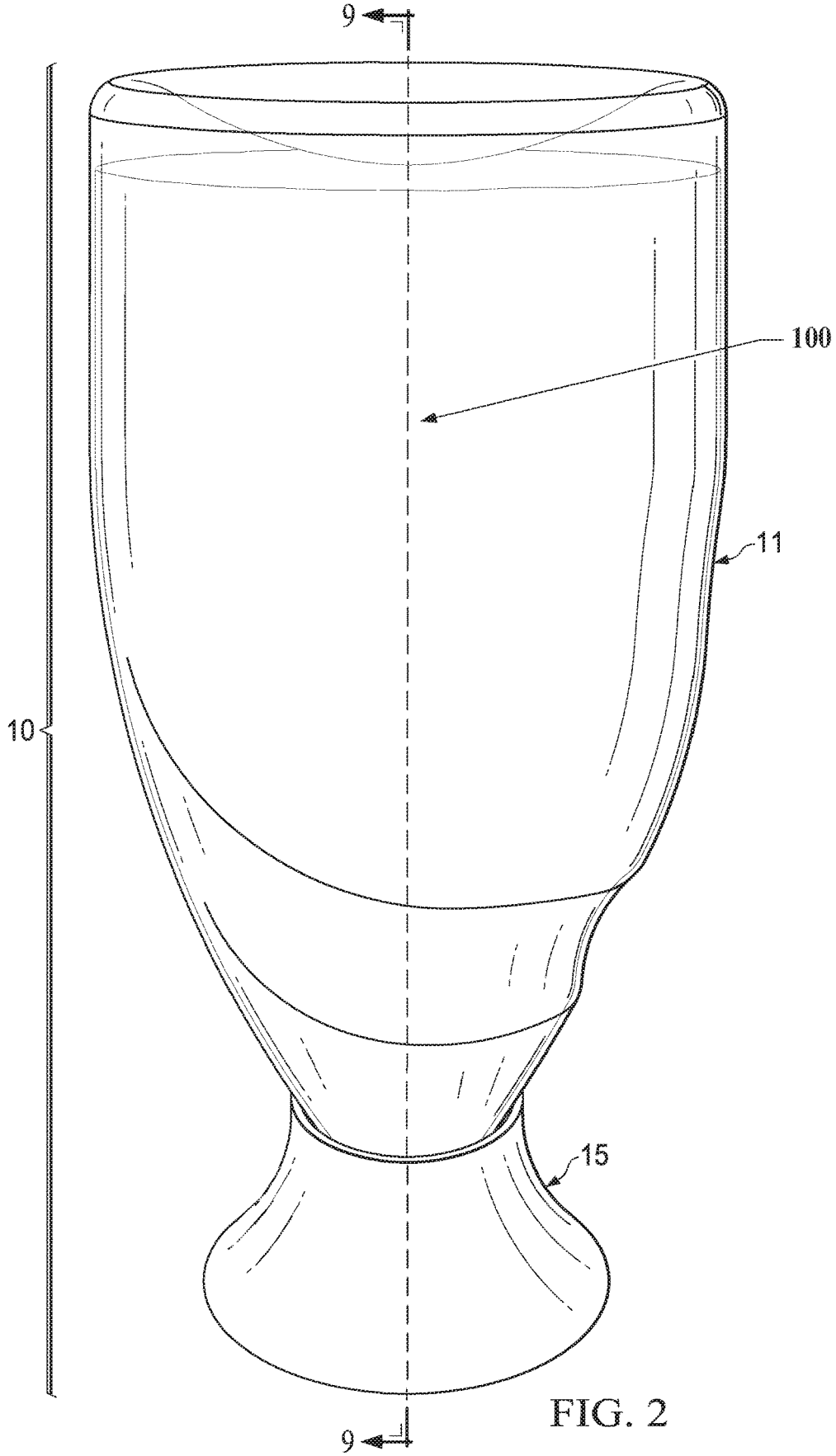
FIG. 2 shows a perspective view of a cleaning product according to one aspect of the present invention. The cleaning product comprises an inverted container assembly (10) comprising an inverted container (11) connected to the liquid dispenser (15), and cleaning composition (100) contained therein.

For ease of description, the cleaning product of this invention is described with terms such as upper/top, lower/bottom, horizontal, etc. in reference to the position show in FIG. 2. With continued reference to FIG. 2, it will be understood that the cleaning product of the invention comprises an inverted container assembly (10) and a liquid hand dishwashing cleaning composition (100) contained in the inverted container assembly (10). The inverted container assembly (10) comprises an inverted container (11) having a bottom surface (12) (not shown) and a top surface (13) located away from the bottom surface (12). The bottom surface (12) has an opening (14) and a liquid dispenser (15) is attached, preferably releasably attached, to the bottom surface (12) of the inverted container (11) accommodating the liquid to be dispensed from the bottom of the inverted container (11).

Cleaning Composition

The cleaning composition (100) of the present invention will comprise a specific surfactant system to provide improved leakage and/or stringing prevention while also enabling product lower shear viscosity profile. The composition comprises from 1% to 60%, preferably from 5% to 50%, more preferably from 8% to 45%, most preferably from 15% to 40%, by weight of the total composition of a surfactant system. The surfactant system comprises an anionic surfactant and a primary co-surfactant in a weight ratio of from 8:1 to 1:1, preferably 4:1 to 2:1, more preferably from 3.5:1 to 2.5:1.

Preferably, the pH of the cleaning composition (100) is from 5 to 12, more preferably from 7.5 to 10, as measured at 10% dilution in distilled water at 20° C. The pH of the composition can be adjusted using pH modifying ingredients known in the art.

The composition of the present invention can be Newtonian or non-Newtonian, preferably Newtonian. Preferably, the composition has a shear viscosity of from 10 mPa·s to 10,000 mPa·s, preferably from 100 mPa·s to 5,000 mPa·s, more preferably from 300 mPa·s to 2,000 mPa·s, or most preferably from 500 mPa·s to 1,500 mPa·s, alternatively combinations thereof. Shear viscosity is measured according to the Shear Viscosity Test Method as described herein.

Preferably, the composition has a density between 0.5 g/mL and 2 g/mL, more preferably between 0.8 g/mL and 1.5 g/mL, most preferably between 1 g/mL and 1.2 g/mL.

The cleaning composition (100) of the invention is especially suitable for use as a hand dishwashing detergent. It is extremely suitable for use in diluted form in a full sink of water to wash dishes. It can also be used when dosed directly on soiled dishware or on an optionally pre-wetted cleaning implement, preferably a sponge.

Anionic Surfactant

Preferably, the surfactant system for the cleaning composition (100) of the present invention comprises from 60% to 90%, preferably from 65% to 85%, more preferably from 70% to 80%, by weight of the surfactant system of an anionic surfactant. The anionic surfactant can be any anionic cleaning surfactant, preferably selected from sulphate and/or sulfonate and/or sulfosuccinate anionic surfactants. Especially preferred anionic surfactant is selected from the group consisting of an alkyl sulfate, an alkyl alkoxy sulfate, and mixtures thereof. Preferred anionic surfactant is an alkyl ethoxy sulfate or a mixed alkyl sulfate-alkyl ethoxy sulfate anionic surfactant system, with a mol average ethoxylation degree of less than 5, preferably less than 3, more preferably less than 2 and more than 0.5.

Preferably the alkyl ethoxy sulfate, or mixed alkyl sulfate-alkyl ethoxy sulfate, anionic surfactant has a weight average level of branching of from 5% to 60%, preferably from 10% to 50%, more preferably from 20% to 40%. This level of branching contributes to better dissolution and suds lasting. It also contributes to the stability of the detergent at low temperature. Preferably the alkyl ethoxy sulfate anionic surfactant, or mixed alkyl sulfate-alkyl ethoxy sulfate anionic surfactant, has an average alkyl carbon chain length of from 8 to 16, preferably from 12 to 15, more preferably from 12 to 14, and preferably a weight average level of branching between 25% and 45%. Detergents having this ratio present good dissolution and suds performance. Beyond controlling alkyl carbon chain length, average ethoxylation degree and average branching will also help control the shear viscosity of the cleaning composition (100) without the excessive need of organic solvents.

When the alkyl ethoxylated sulfate anionic surfactant is a mixture, the average alkoxylation degree is the mol average alkoxylation degree of all the components of the mixture (i.e., mol average alkoxylation degree). In the mol average alkoxylation degree calculation the weight of sulfate anionic surfactant components not having alkoxylate groups should also be included.

$$\text{Mol average alkoxylation degree}=(x1*\text{alkoxylation degree of surfactant 1}+x2*\text{alkoxylation degree of surfactant 2}+\ldots)/(x1+x2+\ldots)$$

wherein x1, x2, . . . are the number of moles of each sulfate anionic surfactant of the mixture and alkoxylation degree is the number of alkoxy groups in each sulfate anionic surfactant.

If the surfactant is branched, the preferred branching group is an alkyl. Typically, the alkyl is selected from methyl, ethyl, propyl, butyl, pentyl, cyclic alkyl groups and mixtures thereof. Single or multiple alkyl branches could be present on the main hydrocarbyl chain of the starting alcohol(s) used to produce the sulfate anionic surfactant used in the composition of the invention.

The branched sulfate anionic surfactant can be a single anionic surfactant or a mixture of anionic surfactants. In the case of a single surfactant the percentage of branching refers to the weight percentage of the hydrocarbyl chains that are branched in the original alcohol from which the surfactant is derived.

In the case of a surfactant mixture the percentage of branching is the weight average and it is defined according to the following formula:

$$\text{Weight average of branching (\%)}=[(x1*\text{wt \% branched alcohol 1 in alcohol 1}+x2*\text{wt \% branched alcohol 2 in alcohol 2}+\ldots)/(x1+x2+\ldots)]*100$$

wherein x1, x2, are the weight in grams of each alcohol in the total alcohol mixture of the alcohols which were used as starting material for the anionic surfactant for the detergent of the invention. In the weight average branching degree calculation, the weight of anionic surfactant components not having branched groups should also be included.

Suitable counterions include alkali metal cation, earth alkali metal cation, alkanolammonium or ammonium or substituted ammonium, but preferably sodium.

Suitable examples of commercially available sulfates include, those based on Neodol alcohols ex the Shell company, Lial-Isalchem and Safol® ex the Sasol company, natural alcohols ex The Procter & Gamble Chemicals company. Suitable sulfonate surfactants for use herein include water-soluble salts of C8-C18 alkyl or hydroxyalkyl sulfonates; C11-C18 alkyl benzene sulfonates (LAS), modified alkylbenzene sulfonate (MLAS); methyl ester sulfonate (MES); and alpha-olefin sulfonate (AOS). Those also include the paraffin sulfonates may be monosulfonates and/or disulfonates, obtained by sulfonating paraffins of 10 to 20 carbon atoms. The sulfonate surfactant also includes the alkyl glyceryl sulfonate surfactants.

Primary Co-Surfactant System

The surfactant system of the composition of the present invention comprises a primary co-surfactant system. The composition preferably comprises from 0.1% to 20%, more preferably from 0.5% to 15%, and especially from 2% to 10% by weight of the cleaning composition (100) of the primary co-surfactant system. Preferably, the surfactant system for the cleaning composition (100) of the present invention comprises from 10% to 40%, preferably from 15% to 35%, more preferably from 20% to 30%, by weight of the surfactant system of a primary co-surfactant.

As used herein, the term "primary cosurfactant" means the non-anionic surfactant present at the highest level amongst all the cosurfactants co-formulated with the anionic surfactant. Preferably the primary co-surfactant is selected from the group consisting of an amphoteric surfactant, a zwitterionic surfactant, and mixtures thereof.

The composition of the present invention will preferably comprise an amine oxide as the amphoteric surfactant. Preferably, the amine oxide surfactant is selected from the group consisting of a linear or branched alkyl amine oxide surfactant, a linear or branched alkyl amidopropyl amine oxide surfactant, and mixtures thereof, more preferably a linear alkyl dimethyl amine oxide surfactant, even more preferably a linear C10 alkyl dimethyl amine oxide surfactant, a linear C12-C14 alkyl dimethyl amine oxide surfactant, and mixtures thereof, most preferably a linear C12-C14 alkyl dimethyl amine oxide surfactant.

Preferably, the amine oxide surfactant is alkyl dimethyl amine oxide or alkyl amido propyl dimethyl amine oxide, preferably alkyl dimethyl amine oxide and especially coco dimethyl amino oxide, most preferably C12-C14 alkyl dimethyl amine oxide.

Alternatively, the amine oxide surfactant is a mixture of amine oxides comprising a low-cut amine oxide and a mid-cut amine oxide. The amine oxide of the composition of the invention then comprises:

a) from 10% to 45% by weight of the amine oxide of low-cut amine oxide of formula R1R2R3AO wherein R1 and R2 are independently selected from hydrogen, C1-C4 alkyls or mixtures thereof, and R3 is selected from C10 alkyls or mixtures thereof; and b) from 55% to 90% by weight of the amine oxide of mid-cut amine oxide of formula R4R5R6AO wherein R4 and R5 are independently selected from hydrogen, C1-C4 alkyls or mixtures thereof, and R6 is selected from C12-C16 alkyls or mixtures thereof.

In a preferred low-cut amine oxide for use herein R3 is n-decyl. In another preferred low-cut amine oxide for use herein R1 and R2 are both methyl. In an especially preferred low-cut amine oxide for use herein R1 and R2 are both methyl and R3 is n-decyl.

Preferably, the amine oxide comprises less than 5%, more preferably less than 3%, by weight of the amine oxide of an amine oxide of formula R7R8R9AO wherein R7 and R8 are selected from hydrogen, C1-C4 alkyls and mixtures thereof and wherein R9 is selected from C8 alkyls and mixtures thereof. Compositions comprising R7R8R9AO tend to be unstable and do not provide very suds mileage.

Preferably, the zwitterionic surfactant is a betaine surfactant. Suitable betaine surfactant includes alkyl betaines, alkylamidobetaine, amidazoliniumbetaine, sulfobetaine (INCI Sultaines) as well as the Phosphobetaine and preferably meets Formula (I):

$$R^1—[CO—X(CH_2)_n]_x—N^+(R^2(R_3)—(CH_2)_m—[CH(OH)—CH_2]_y—Y— \quad (I)$$

wherein

R1 is a saturated or unsaturated C6-22 alkyl residue, preferably C8-18 alkyl residue, in particular a saturated C10-16 alkyl residue, for example a saturated C12-14 alkyl residue;

X is NH, NR4 with C1-4 Alkyl residue R4, O or S, n is a number from 1 to 10, preferably 2 to 5, in particular 3, x is 0 or 1, preferably 1, R2 and R3 are independently a C1-4 alkyl residue, potentially hydroxy substituted such as a hydroxyethyl, preferably a methyl, m is a number from 1 to 4, in particular 1, 2 or 3, y is 0 or 1, and Y is COO, $SO_3$, OPO(OR5)O or P(O)(OR5)O, whereby R5 is a hydrogen atom H or a C1-4 alkyl residue.

Preferred betaines are the alkyl betaines of the Formula (Ia), the alkyl amido propyl betaine of the Formula (Ib), the Sulfo betaines of the Formula (Ic) and the Amido sulfobetaine of the Formula (Id):

$$R^1—N(CH_3)_2—CH_2COO— \quad (Ia)$$

$$R^1—CO—NH(CH_2)_3—N^+(CH_3)_2—CH_2COO— \quad (Ib)$$

$$R^1—N^+(CH_3)_2—CH_2CH(OH)CH_2SO_3— \quad (Ic)$$

$$R^1—CO—NH—(CH_2)_3—N^+(CH_3)_2—CH_2CH(OH)CH_2SO_3— \quad (Id)$$

in which R1 has the same meaning as in Formula (I). Particularly preferred betaines are the Carbobetaine [wherein Y——COO—], in particular the Carbobetaine of the Formulae (Ia) and (Ib), more preferred are the Alkylamidobetaine of the Formula (Ib).

A preferred betaine is, for example, cocoamidopropylbetaine.

Preferably, the surfactant system of the composition of the present invention comprises a surfactant system wherein the weight ratio of the anionic surfactant to the primary co-surfactant, preferably the anionic surfactant to the amine oxide surfactant is from 8:1 to 1:1, preferably 4:1 to 2:1, more preferably from 3.5:1 to 2.5:1.

Non-Ionic Surfactant

Preferably the surfactant system of the composition of the present invention further comprises from 0.1% to 10% by weight of the total composition of a secondary co-surfactant system. As used herein, the term "secondary co-surfactant" means the co-surfactant present at the second highest level asides from the anionic surfactant as the main surfactant, i.e., anionic surfactant present at the highest level and the amphoteric/zwitterionic/mixtures thereof as primary co-surfactant. Preferably the secondary co-surfactant system comprises a non-ionic surfactant. Preferably, the surfactant system of the composition of the present invention further comprises from 1% to 25%, preferably from 1.25% to 20%, more preferably from 1.5% to 15%, most preferably from 1.5% to 5% by weight of the surfactant system, of a non-ionic surfactant.

Preferably, the non-ionic surfactant is a linear or branched, primary or secondary alkyl alkoxylated non-ionic surfactant, preferably an alkyl ethoxylated non-ionic surfactant, preferably comprising on average from 9 to 15, preferably from 10 to 14 carbon atoms in its alkyl chain and on average from 5 to 12, preferably from 6 to 10, most preferably from 7 to 8, units of ethylene oxide per mole of alcohol. Other suitable non-ionic surfactants for use herein include fatty alcohol polyglycol ethers, alkylpolyglucosides and fatty acid glucamides, preferably alkylpolyglucosides. Preferably the alkyl polyglucoside surfactant is a C8-C16 alkyl polyglucoside surfactant, preferably a C8-C14 alkyl polyglucoside surfactant, preferably with an average degree of polymerization of between 0.1 and 3, more preferably between 0.5 and 2.5, even more preferably between 1 and 2. Most preferably the alkyl polyglucoside surfactant has an average alkyl carbon chain length between 10 and 16, preferably between 10 and 14, most preferably between 12 and 14, with an average degree of polymerization of between 0.5 and 2.5 preferably between 1 and 2, most preferably between 1.2 and 1.6. C8-C16 alkyl polyglucosides are commercially available from several suppliers (e.g., Simusol® surfactants from Seppic Corporation; and Glucopon® 600 CSUP, Glucopon® 650 EC, Glucopon® 600 CSUP/MB, and Glucopon® 650 EC/MB, from BASF Corporation). Preferably, the composition comprises the anionic surfactant and the non-ionic surfactant in a ratio of from 2:1 to 50:1, preferably 2:1 to 10:1.

Amphiphilic Polymer

Preferably, the composition of the present invention may further comprise from 0.01% to 5%, preferably from 0.2% to 3%, more preferably from 0.3% to 1% by weight of the total composition of an amphiphilic polymer selected from the groups consisting of amphiphilic alkoxylated polyalkyleneimine and mixtures thereof, preferably an amphiphilic alkoxylated polyalkyleneimine.

Preferably, the amphiphilic alkoxylated polyalkyleneimine is an alkoxylated polyethyleneimine polymer comprising a polyethyleneimine backbone having average molecular weight range from 100 to 5,000 Daltons, preferably from 400 to 2,000 Daltons, more preferably from 400 to 1,000 Daltons and the alkoxylated polyethyleneimine polymer further comprising:

(i) one or two alkoxylation modifications per nitrogen atom by a polyalkoxylene chain having an average of about 1 to about 50 alkoxy moieties per modification, wherein the terminal alkoxy moiety of the alkoxylation modification is capped with hydrogen, a C1-C4 alkyl or mixtures thereof;

(ii) an addition of one C1-C4 alkyl moiety and one or two alkoxylation modifications per nitrogen atom by a polyalkoxylene chain having an average of about 1 to about 50 alkoxy moieties per modification wherein the terminal alkoxy moiety is capped with hydrogen, a C1-C4 alkyl or mixtures thereof; or (iii) a combination thereof; and wherein the alkoxy moieties comprises ethoxy (EO) and/or propxy (PO) and/or butoxy (BO) and wherein when the alkoxylation modification comprises EO it also comprises PO or BO.

Preferred amphiphilic alkoxylated polyethyleneimine polymers comprise EO and PO groups within their alkoxylation chains, the PO groups preferably being in terminal position of the alkoxy chains, and the alkoxylation chains preferably being hydrogen capped.

For example, but not limited to, below is shown possible modifications to terminal nitrogen atoms in the polyethyleneimine backbone where R represents an ethylene spacer and E represents a C1-C4 alkyl moiety and X— represents a suitable water soluble counterion.

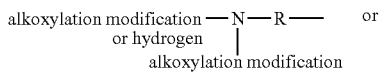

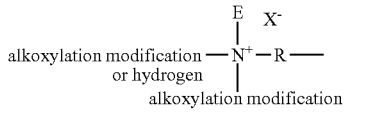

Also, for example, but not limited to, below is shown possible modifications to internal nitrogenatoms in the polyethyleneimine backbone where R represents an ethylene spacer and E represents a $C_1$-$C_4$ alkyl moiety and X— represents a suitable water soluble counterion.

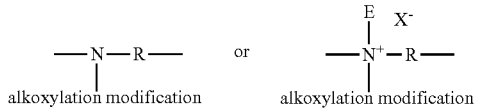

The alkoxylation modification of the polyethyleneimine backbone consists of the replacement of a hydrogen atom by a polyalkoxylene chain having an average of about 1 to about 50 alkoxy moieties, preferably from about 20 to about 45 alkoxy moieties, most preferably from about 30 to about 45 alkoxy moieties. The alkoxy moieties are selected from ethoxy (EO), propoxy (PO), butoxy (BO), and mixtures thereof. Alkoxy moieties solely comprising ethoxy units are outside the scope of the invention though. Preferably, the polyalkoxylene chain is selected from ethoxy/propoxy block moieties. More preferably, the polyalkoxylene chain is ethoxy/propoxy block moieties having an average degree of ethoxylation from 3 to 30 and an average degree of propoxylation from 1 to 20, more preferably ethoxy/propoxy block moieties having an average degree of ethoxylation from 20 to 30 and an average degree of propoxylation from 10 to 20.

More preferably the ethoxy/propoxy block moieties have a relative ethoxy to propoxy unit ratio between 3 to 1 and 1 to 1, preferably between 2 to 1 and 1 to 1. Most preferably the polyalkoxylene chain is the ethoxy/propoxy block moieties wherein the propoxy moiety block is the terminal alkoxy moiety block.

The modification may result in permanent quaternization of the polyethyleneimine backbone nitrogen atoms. The degree of permanent quaternization may be from 0% to 30% of the polyethyleneimine backbone nitrogen atoms. It is preferred to have less than 30% of the polyethyleneimine backbone nitrogen atoms permanently quaternized. Most preferably the degree of quaternization is 0%.

A preferred polyethyleneimine has the general structure of Formula (II):

(II)

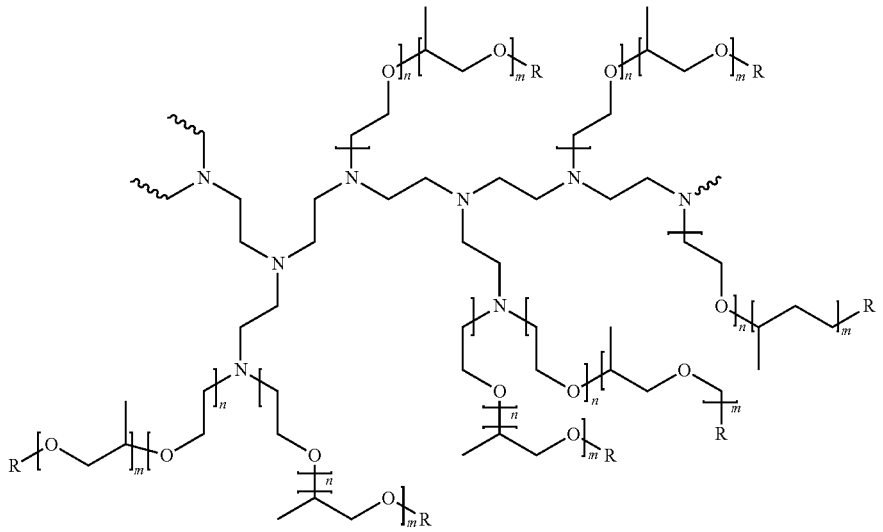

wherein the polyethyleneimine backbone has a weight average molecular weight of 600, n of formula (II) has an average of 10, m of formula (II) has an average of 7 and R of formula (II) is selected from hydrogen, a $C_1$-$C_4$ alkyl and mixtures thereof, preferably hydrogen. The degree of permanent quaternization of formula (II) may be from 0% to 22% of the polyethyleneimine backbone nitrogen atoms. The molecular weight of this polyethyleneimine preferably is between 10,000 and 15,000.

An alternative polyethyleneimine has the general structure of Formula (II) but wherein the polyethyleneimine backbone has a weight average molecular weight of 600, n of Formula (II) has an average of 24, m of Formula (II) has an average of 16 and R of Formula (II) is selected from hydrogen, a $C_1$-$C_4$ alkyl and mixtures thereof, preferably hydrogen. The degree of permanent quaternization of Formula (II) may be from 0% to 22% of the polyethyleneimine backbone nitrogen atoms. The molecular weight of this polyethyleneimine preferably is between 25,000 and 30,000.

Most preferred polyethyleneimine has the general structure of Formula (II) wherein the polyethyleneimine backbone has a weight average molecular weight of 600, n of Formula (II) has an average of 24, m of Formula (II) has an average of 16 and R of Formula (II) is hydrogen. The degree of permanent quaternization of Formula (II) is 0% of the polyethyleneimine backbone nitrogen atoms. The molecular weight of this polyethyleneimine preferably is from 25,000 to 30,000, most preferably 28,000.

These polyethyleneimines can be prepared, for example, by polymerizing ethyleneimine in the presence of a catalyst such as carbon dioxide, sodium bisulfite, sulfuric acid, hydrogen peroxide, hydrochloric acid, acetic acid, and the like, as described in more detail in PCT Publication No. WO 2007/135645.

Triblock Co-Polymer

The alkylene oxide triblock copolymer of the present invention is defined as a triblock co-polymer having alkylene oxide moieties according to Formula (I):

$$(EO)x(PO)y(EO)x \quad (I)$$

wherein EO represents ethylene oxide, and each x represents the number of EO units within the EO block. Each x is independently on average between 1 and 80, preferably between 3 and 60, more preferably between 5 and 50, most preferably between 5 and 30. Preferably x is the same for both EO blocks, wherein the "same" means that the x between the two EO blocks varies within a maximum 2 units, preferably within a maximum of 1 unit, more preferably both x's are the same number of units. PO represents propylene oxide, and y represents the number of PO units in the PO block. Each y is on average between 1 and 60, preferably between 10 and 55, more preferably between 10 and 50, more preferably between 15 and 48.

Preferably the triblock co-polymer has a ratio of y to each x of from 1:1 to 3:1, preferably from 1.5:1 to 2.5:1. Preferably the triblock co-polymer has an average weight percentage of total EO of between 30% and 50% by weight of the triblock co-polymer. Preferably the triblock co-polymer has an average weight percentage of total PO of between 50% and 70% by weight of the triblock copolymer. It is understood that the average total weight % of EO and PO for the triblock co-polymer adds up to 100%. The triblock co-polymer has an average molecular weight of between 140 and 10500, preferably between 800 and 8500, more preferably between 1000 and 7300, even more preferably between 1300 and 5500, most preferably between 2000 and 4800. Average molecular weight is determined using a 1H NMR spectroscopy (see Thermo scientific application note No. AN52907). It is an established tool for polymer characterization, including molecular weight determination and copolymer composition analysis.

Cyclic Polyamine

Preferably, the cleaning composition (100) further comprises cyclic polyamine. The cyclic polyamine of the invention is a cleaning polyamine. The cleaning polyamine comprises amine functionalities that helps cleaning as part of a cleaning composition (100). The composition of the invention preferably comprises from 0.1% to 10%, more preferably from 0.2% to 5%, and especially from 0.3% to 2%, by weight of the composition, of the cyclic polyamine.

The term "cyclic amine" herein encompasses a single amine and a mixture thereof. The amine can be subjected to protonation depending on the pH of the cleaning medium in which it is used. The cyclic polyamine of the invention conforms to the following Formula (I):

(I)

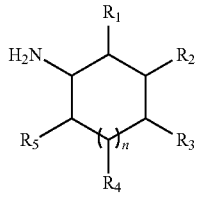

wherein $R_1$, $R_2$, $R_3$, $R_4$ and $R_5$ are independently selected from the group consisting of NH2, —H, linear or branched alkyl having from 1 to 10 carbon atoms, and linear or branched alkenyl having from 1 to 10 carbon atoms, n is from 0 to 3, preferably n is 1, and wherein at least one of the Rs is NH2 and the remaining "Rs" are independently selected from the group consisting of NH2, —H, linear or branched alkyl having 1 to 10 carbon atoms, and linear or branched alkenyl having from 1 to 10 carbon atoms. Preferably, the cyclic polyamine is a diamine, wherein n is 1, $R_2$ is NH2, and at least one of $R_1$, $R_3$, $R_4$ and $R_5$ is CH3 and the remaining Rs are H.

The amine of the invention is a cyclic amine with at least two primary amine functionalities. The primary amines can be in any position in the cyclic amine but it has been found that in terms of grease cleaning, better performance is obtained when the primary amines are in positions 1,3. It has also been found that cyclic amines in which one of the substituents is —CH3 and the rest are H provided for improved grease cleaning performance. Accordingly, the most preferred cyclic polyamine for use with the cleaning composition (100) of the present invention are cyclic polyamine selected from the group consisting of 2-methylcyclohexane-1,3-diamine, 4-methylcyclohexane-1,3-diamine and mixtures thereof.

The composition of the present invention may comprise at least one active selected from the group consisting of: i) a salt, ii) a hydrotrope, iii) an organic solvent, and mixtures thereof.

Salt

The composition of the present invention may comprise from 0.05% to 2%, preferably from 0.1% to 1.5%, or more preferably from 0.5% to 1%, by weight of the total composition of a salt, preferably a monovalent, divalent inorganic salt or a mixture thereof, more preferably sodium chloride, sodium sulphate or a mixture thereof, most preferably sodium chloride.

Hydrotrope

The composition of the present invention may comprise from 0.1% to 10%, or preferably from 0.5% to 10%, or more preferably from 1% to 10% by weight of the total composition of a hydrotrope or a mixture thereof, preferably sodium cumene sulfonate.

Organic Solvent

The composition of the present invention may comprise an organic solvent. Suitable organic solvents include C4-14 ethers and diethers, polyols, glycols, alkoxylated glycols, C6-C16 glycol ethers, alkoxylated aromatic alcohols, aromatic alcohols, aliphatic linear or branched alcohols, alkoxylated aliphatic linear or branched alcohols, alkoxylated C1-C5 alcohols, C8-C14 alkyl and cycloalkyl hydrocarbons and halohydrocarbons, and mixtures thereof. Preferably the organic solvents include alcohols, glycols, and glycol ethers, alternatively alcohols and glycols. The composition comprises from 0% to less than 50%, preferably from 0.01% to 25%, more preferably from 0.1% to 10%, or most preferably from 0.5% to 5%, by weight of the total composition of an organic solvent, preferably an alcohol, more preferably ethanol, a polyalkyleneglycol, more preferably polypropyleneglycol, and mixtures thereof.

Adjunct Ingredients

The cleaning composition (100) herein may optionally comprise a number of other adjunct ingredients such as builders (e.g., preferably citrate), chelants, conditioning polymers, cleaning polymers, surface modifying polymers, soil flocculating polymers, structurants, emollients, humectants, skin rejuvenating actives, enzymes, carboxylic acids, scrubbing particles, bleach and bleach activators, perfumes, malodor control agents, pigments, dyes, opacifiers, beads, pearlescent particles, microcapsules, inorganic cations such as alkaline earth metals such as Ca/Mg-ions, antibacterial agents, preservatives, viscosity adjusters (e.g., salt such as NaCl, and other mono-, di- and trivalent salts) and pH adjusters and buffering means (e.g. carboxylic acids such as citric acid, HCl, NaOH, KOH, alkanolamines, phosphoric and sulfonic acids, carbonates such as sodium carbonates, bicarbonates, sesquicarbonates, borates, silicates, phosphates, imidazole and alike).

The elements of the composition of the invention described in connexion with the first aspect of the invention apply mutatis mutandis to the other aspects of the invention.

Inverted Container Assembly

The inverted container assembly (10) comprises an inverted container (11) and a liquid dispenser (15) attached to the bottom surface (12) of the inverted container (11).

Liquid Dispenser

Figure 3:
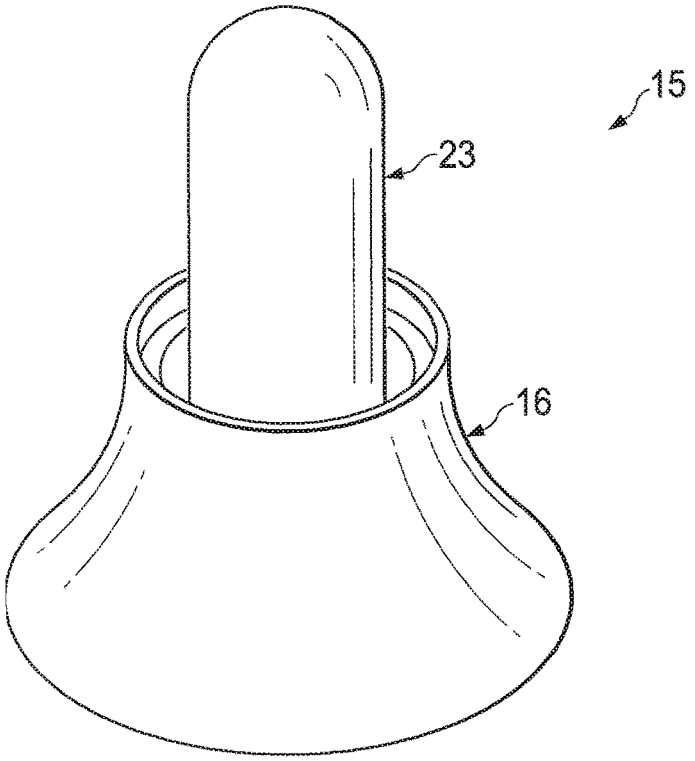
FIG. 3 shows a perspective view of the liquid dispenser (15) according to the present invention.

As shown in FIG. 3, the liquid dispenser (11) comprises three basic components a body (16), a valve (19) (not shown) and preferably an impact resistance system (23). Preferably, the liquid dispenser (15) is free of a closing cap or seal. Typically a seal is included for transport and is removed and discarded after the first use of the cleaning product.

Figure 4:
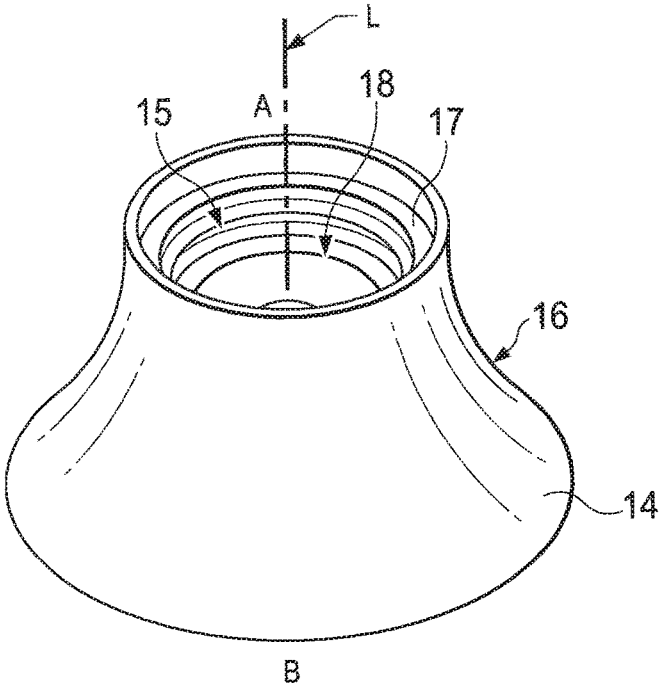
FIG. 4 shows a perspective view of the body (16) of the liquid dispenser (15) according to the present invention.

With reference to FIG. 4, the liquid dispenser (15) comprises a body (16). The body (16) includes at the top end (A) a connecting sleeve (17) adapted for engaging, preferably releasably engaging, to an exterior surface proximate an opening (14) at the bottom of the inverted container (11). Preferably this arrangement provides leak-tight contact between the liquid dispenser (15) and the inverted container (11), which helps to prevent leakage.

Alternatively, the connecting sleeve (17) may be adapted for engaging, preferably releasably engaging, to an interior surface proximate an opening (14) of the inverted container (11). In other words, the inverted container (11) is attached to the connecting sleeve (17) located on the horizontal exterior of the body (16) of the liquid dispenser (15). However this alternative arrangement is less preferred since there is a higher leakage risk of liquid passing through the contacts between the dispenser (15) and the inverted container (11).

The body (16) can be engaged, preferably releasably engaged, to the opening (14) of the inverted container (11) by suitable means of attachment commonly known to those skilled in the art, including for non-limiting example cooperative threads, crimping, clipping means, clasp-means, snap-fit means, groove arrangements, bayonet fittings, or permanently welded. Preferably, the male thread on the exterior surface of the opening (14) of the inverted container (11) is screwed on the female thread which has been molded onto the connecting sleeve (17) (as illustrated in FIG. 4).

The body (16) includes a central portion (15) axially disposed along the longitudinal axis (L). The connecting sleeve (17) is preferably spaced radially inwardly towards the central portion (15) and defines an internal discharge conduit (18). This discharge conduit (18) functions as a flow passage for establishing fluid communication with the liquid contained in the inverted container (11) to the exterior atmosphere. It will be understood that in use, the connecting sleeve (17) forms a fluid seal between the liquid dispenser (15) and the inverted container (11) contained in the inverted container (11) so that the cleaning composition (100) can enter the liquid dispenser (15) without leaking.

Preferably, the body (16) comprises at a bottom end (B) an exterior portion (14) adapted to allow the inverted container (11) to stably rest on its bottom on a flat surface (as shown in FIG. 2). The exterior portion (14) may be integrally formed with the body (16). For example, the exterior portion (14) comprises an annular flange structure (e.g., skirt) that extends axially downward towards the bottom (B) and radially outward as shown in FIG. 4. While FIG. 4 depicts the exterior portion (14) of the body (16) as having a frustoconical shape, it is not necessarily limited to this shape. Other shapes such as cylindrical, pyramid shape, disk shape, multiple legs, etc. could be used so long as they allow for the inverted container (11) to remain stably rested on its bottom It should be understood that while the body (16) has been shown and described herein, there are many variations that may be desirable depending on the particular requirements. For example, while the connecting sleeve (17) and the exterior portion (14) have been shown as having uniform material thickness, in some applications it may be desirable for the material thickness to vary. By way of further example, while a number of surfaces have been described herein as having a specific shape (e.g., frustoconcial, planar, etc.) other specific shapes may be desirable for those surfaces depending upon the particular application.

Figure 5:
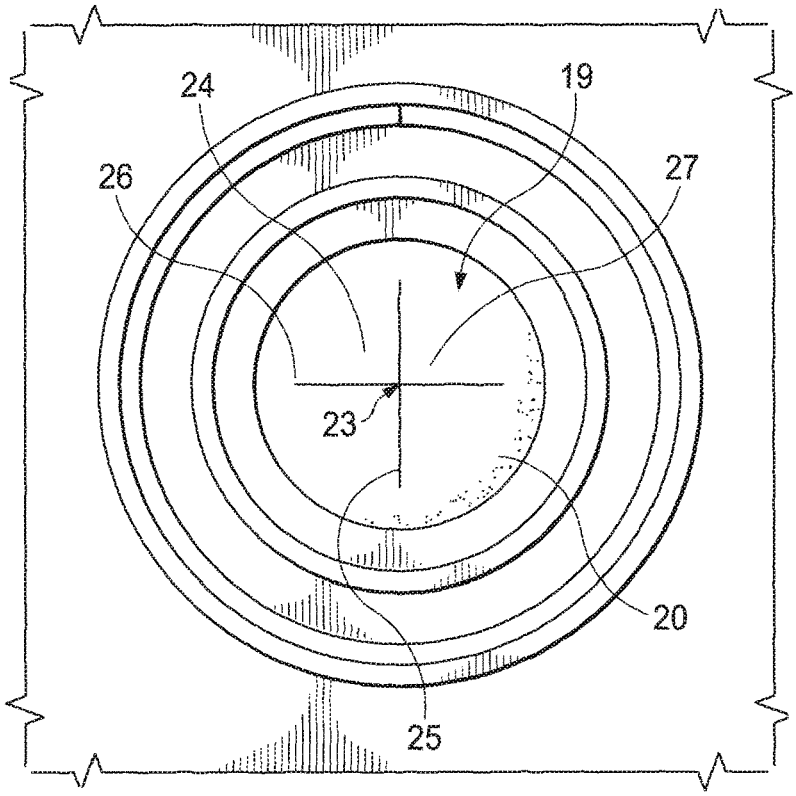
FIG. 5 shows a plan top view of the interior side (20) of the valve (19) of the liquid dispenser (15) according to the present invention.
Figure 6:
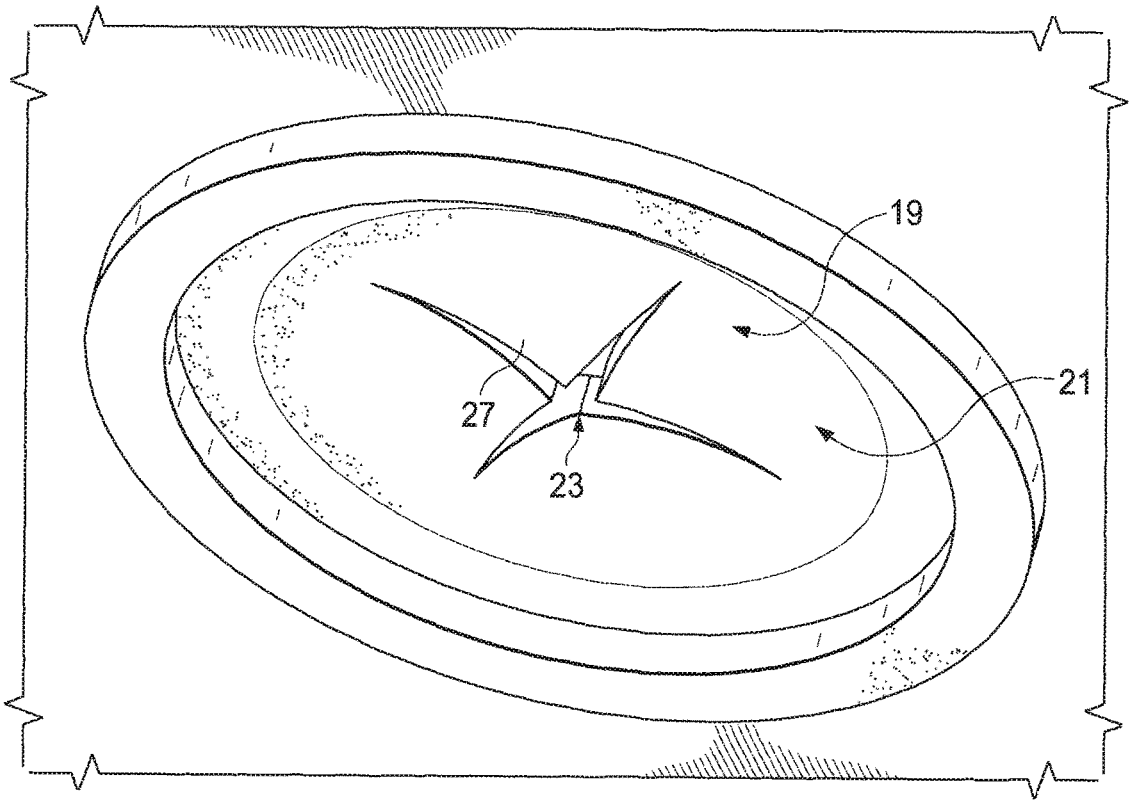
FIG. 6 shows a perspective bottom view of the exterior side (21) of the valve (19) of the liquid dispenser (15) according to the present invention.

Preferably, the liquid dispenser (15) further comprises a valve (19) localized in the body (16) extending across the internal discharge conduit (18). As shown by FIG. 5, the valve (19) has an interior side (20) for being contacted by the cleaning composition (100) contained inside the inverted container (11) and an exterior side (22) (as shown in FIG. 6) for being exposed to the exterior atmosphere. The valve (19) defines a dispensing orifice (22) that is reactably openable when the pressure on the valve interior side (20) exceeds the pressure on the valve exterior side (21).

The valve (19) is preferably a flexible, elastomeric, resilient, 2-way bi-directional, self-closing, slit-type valve mounted in the body (16). The valve (19) has slit of slits (25) which define the dispensing orifice (23). For example, the dispensing orifice (23) may be formed from one slit (25) or two or more intersecting slits (25), that may open to permit dispensing of liquid therethrough in response to an increased pressure inside the inverted container (11), such as for example, when the inverted container (11) is squeezed.

The valve (19) is typically designed so as to reactably close the dispensing orifice (23) and stop the flow of liquid therethrough upon a reduction of the pressure differential across the valve (19). The amount of pressure needed to keep the valve (19) in the closed position will partially depend on the internal resistance force of the valve (19). The "internal resistance force" (i.e., cracking-pressure) refers to a predetermined resistance threshold to deformation/opening of the valve (19). In other words, the valve (20) will not tend to resist deformation/opening so that it remains closed under pressure of the steady state liquid bearing against the interior side (20) of the valve (19). The amount of pressure needed to deform/open the valve must overcome this internal resistance force. This internal resistance force must not be too low so as to cause liquid leakage or too high to make dispensing a dose of liquid difficult. Accordingly, the valve (19) preferably has an internal resistance force of the valve (19) that is at least 10 mbar, preferably at least 25 mbar, more preferably less than 250 mbar, even more preferably less than 150 mbar, most preferably less than 75 mbar. Preferably, the dispensing orifice (23) is designed to be in the open position when a pressure difference (A) of at least 10 mbar, preferably at least 25 mbar exists between the valve interior side (20) in relation to the valve on the exterior side (21). Preferably the force exerted on the valve interior side (20) that is required in order to open the dispensing orifice (23) is at least 10 mbar, preferably at least 25 mbar. Preferably the valve (10) has a surface area of between 0.1 $cm^2$ and 10 $cm^2$, more preferably between 0.3 $cm^2$ and 5 $cm^2$, most preferably between 0.5 $cm^2$ and 2 $cm^2$. Preferably the valve (19) has a height of between 1 mm and 10 mm, more preferably between 2 mm and 5 mm Other dimensions could be used so long as they allow for the dispensing orifice (23) to remain in the fully closed position at rest.

As shown in FIG. 5, the valve (19) preferably includes a flexible central portion (24) having at least one, preferably at least two, preferably a plurality (i.e., three or more), of planar, self-sealing, slits (25) which extends radially outward towards distal ends (26). It should be understood that slit valve is intended to refer to any valve that has one or more slits in its final functioning form, including such valve wherein one or more of the slits, is/are only fully completed after the valve has been formed and/or installed in the liquid dispenser (1). Each slit (25) preferably terminates just before reaching the distal end (26) in the valve (19). Preferably, the slits (25) are straight (as shown in FIG. 6) or may have various different shapes, sized and/or configurations (not shown). Preferably, the intersecting slits (25) are equally spaced from each other and equal in length.

With continued reference to FIG. 6, the intersecting slits (25) define four, generally sector-shaped, equally sized flaps (27) in the valve (19). The flaps (27) may be characterized as the openable portions of the valve (19) that reacts to pressure differences to change configuration between a closed, rest position (as shown in FIG. 5) and an open position (as shown in FIG. 6). The valve (19) is designed to be flexible enough to accommodate in-venting of exterior atmosphere. For example, as the valve (19) closes, the closing flaps (27) or openable portions can continue moving inwardly pass the closed position to allow the valve flaps (27) to open inwardly when the pressure on the valve exterior side (21) exceeds the pressure on the valve interior side (20) by a predetermined magnitude. Such in-venting capability of the exterior atmosphere helps equalize the interior pressure inside the inverted container (11) with the pressure of the exterior atmosphere. It is understood that the valve (19) is designed so that the opening pressure to vent air back into the inverted container (11) is low enough to avoid paneling of the inverted container (11) during use. In other words, the resilience of the inverted container (11) to return to its initial shape after use (i.e., squeezing force) is higher than the venting opening pressure.

Preferably the valve (19) is not contacting the surface on which the inverted container (11) is standing when at rest, nor contacting the surface to be cleaned upon dosing. Heretofore the valve (19) is augmented into the body (16), preferably being positioned at least 1 mm from the resting surface, more preferably at least 5 mm, even more preferably at least 1 cm. By positioning the valve (19) above rather than in contact with the surface there is less risk of capillary seeping through the valve (19) leading to surface contamination and potentially surface damage upon storage of the inverted container (11).

The valve (19) is preferably molded as a unitary structure from materials which are flexible, pliable, elastic and resilient. Suitable materials include, such as for example, thermosetting polymers, including silicone rubber (available as D.C. 99-595-HC from Dow Corning Corp., USA; WACKER 3003-40 Silicone Rubber Material from Wacker Silicone Co.) preferably having a hardness ration of 40 Shore A, linear low-density polyethylene (LLDPE), low density polyethylene (LDPE), LLDPE/LDPE blends, acetate, acetal, ultra-high-molecular weight polyethylene (UHMW), polyester, urethane, ethylene-vinyl-acetate (EVA), polypropylene, high density polyethylene or thermoplastic elastomer (TPE). The valve (19) can also be formed from other materials such as thermoplastic propylene, ethylene and styrene, including their halogenated counterparts. Suitable valves are commercially available such as from the APTAR Company including the SimpliSqueeze® valve line up.

The valve (19) is normally in the closed position and can withstand the pressure of the liquid inside the inverted container (11) so that the liquid will not leak out unless the inverted container (11) is squeezed. Unfortunately, the design of the valve (19) limits their effectiveness in preventing liquid leakage from inside the inverted container (11) under all situations, particularly when the inverted container (11) has been impacted causing a substantial transient liquid pressure increase. Accordingly, the Applicants have surprisingly discovered that by incorporating a baffle (23) and/or an impact resistance system (23) into the liquid dispenser (15), they can help to absorb the transient liquid pressure increase after the impact and substantially reduce or prevent liquid leakage from the liquid dispenser (15).

Figure 7:
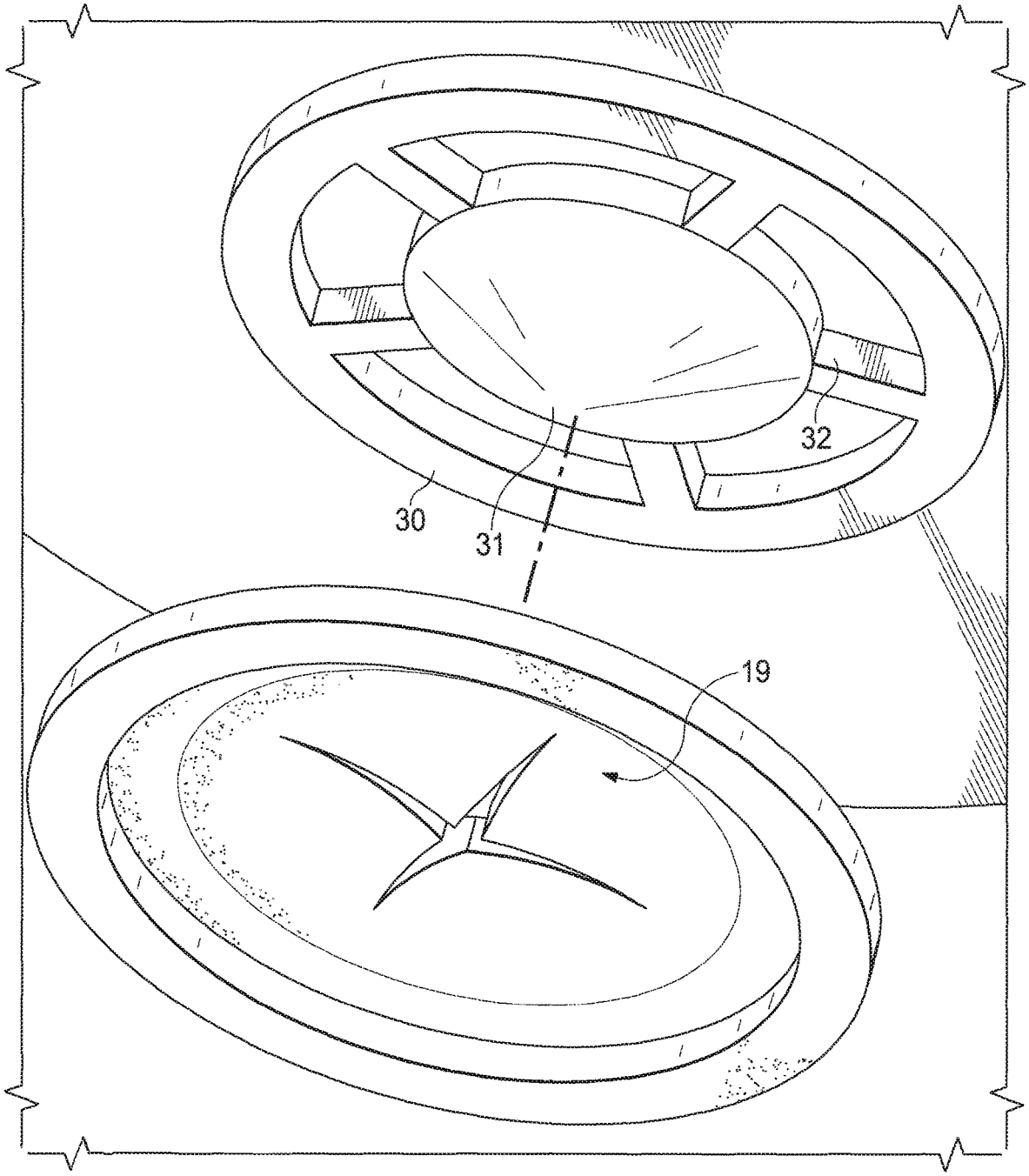
FIG. 7 shows a perspective view of the liquid dispenser (15) of FIG. 3 according to the present invention with a baffle (30).

Preferably, the liquid dispenser (15) further comprises a baffle (30). Preferably the baffle (30), if present, is located between the interior side (20) of the valve (19) and an impact resistance system (23) (as described below). As shown in FIG. 7, the baffle (30) preferably includes an occlusion member (31) supported by at least one support member (32) which accommodates movement of the occlusion member (31) between a closed position occluding liquid flow into at least a portion of the discharged conduit (18) when the baffle (30) is subjected to an upstream hydraulic hammer pressure. Without wishing to be bound by theory, it is believed that the baffle (30) will act as an additional counter-force against the hydraulic hammer, as such further reducing a potential leakage risk. In other words, the baffle (30) functions as a wave breaker to protect the valve (19) from the turbulent kinetic energy of the hydraulic hammer. Suitable custom made baffles (30) can be obtained from the APTAR Group.

Figure 8:
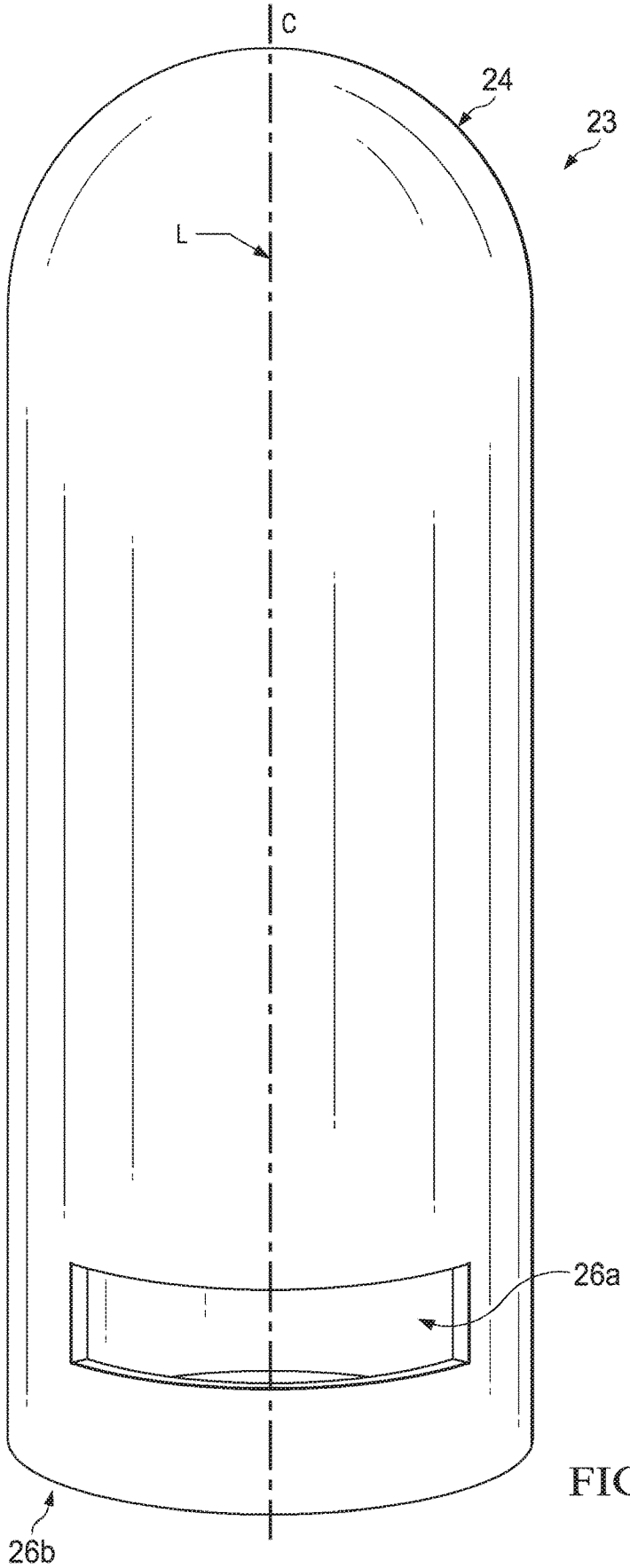
FIG. 8 shows a perspective view of the impact resistance system (23) of the liquid dispenser (15) according to the present invention.

Preferably, the liquid dispenser (15) further comprises an impact resistance system (23) (as shown in FIG. 8) localized upstream of the valve (19). The impact resistance system (23) comprises a housing (24) having a cavity (25) (not shown) therein the housing (24). The housing (24) extends longitudinally from the body (16) radially inward from the sleeve (17). The housing (24) is a substantially rigid structure and may be molded from plastic material, preferably a thermoplastic material, more preferably polypropylene. As shown in FIG. 8, the housing (31) is preferably substantially cylindrical shaped with a dome towards the top end (C) having a length along the longitudinal axis (L) of from 10 mm to 200 mm, preferably from 15 mm to 150 mm, more preferably from 20 mm to 100 mm. The cylindrical shaped housing (24) preferably has a diameter of from 5 mm to 40 mm, preferably from 10 mm to 30 mm. However, it should be understood that the housing (24) may have any desired size and shape, such as for example, oval, pyramid, rectangular, etc. However, the size and shape of the housing (24) will, of necessity, be a function of the internal volume needed for the compressible substance (110). For example, when a higher volume of compressible substance (110) is required, a wider diameter of the housing might be preferred. Preferably, the housing (24) has an inside volume of from 200 $mm^3$ to 250,000 $mm^3$, preferably from 1,500 $mm^3$ to 75,000 $mm^3$. Preferably the compressible substance (110) has a volume of from 1,000 $mm^3$ up to 20,000 $mm^3$, preferably from 1,500 $mm^3$ up to 15,000 $mm^3$, most preferably from 2,000 $mm^3$ up to 10,000 $mm^3$.

Furthermore, the housing (24) comprises at least one inlet opening (26*a*) that provides a flow path for the liquid from the inverted container (11) into the housing (24). Preferably the inlet opening (26*a*) is an opening between the discharge conduit (18) and the valve (19). The phrase "at least one" inlet opening (26*a*) means one or more inlet openings (26*a*) located on the housing (24). For example, it may be desirable to have one larger inlet opening (26*a*) or multiple smaller inlet openings (26*a*). It would be expected that the shear viscosity and density of the liquid contained inside of the inverted container (11) factors into the design of the size, shape and number of the inlet openings (26*a*). The inlet opening (26*a*) functions as an opening for providing a liquid flow path to establishing fluid communication with the liquid contained inside the inverted container (11) and the housing (24). As shown in FIG. 8, the inlet opening (26*a*) is preferably positioned near the bottom of the housing (24) and preferably is rectangular shaped having a length of between 1 mm and 25 mm, preferably between 5 mm and 20 mm, and a height of between 1 mm and 10 mm, preferably between 3 and 7 mm. Alternatively, other shape and sized inlet openings (26*a*) can also be operable so long as they can still provide sufficient flow of liquid from the inverted container (11) into the housing (24). For other non-limiting examples, the housing (24) can contain three small circular inlet openings (26*a*) disposed at equal distance near the bottom or one semi-circle surrounding half of the housing (24). Preferably, the inlet opening (26*a*) has a total surface area of 1 $mm^2$ to 250 $mm^2$, preferably 15 $mm^2$ to 150 $cm^2$. Also it is preferable that the inlet opening (26*a*) is positioned towards the bottom of the housing (24).

The housing (24) further comprises at least one outlet opening (26*b*) that provides a path of egress for the liquid from the housing (24) to the exterior atmosphere when the dispensing orifice (23) is opened.

Figure 9:
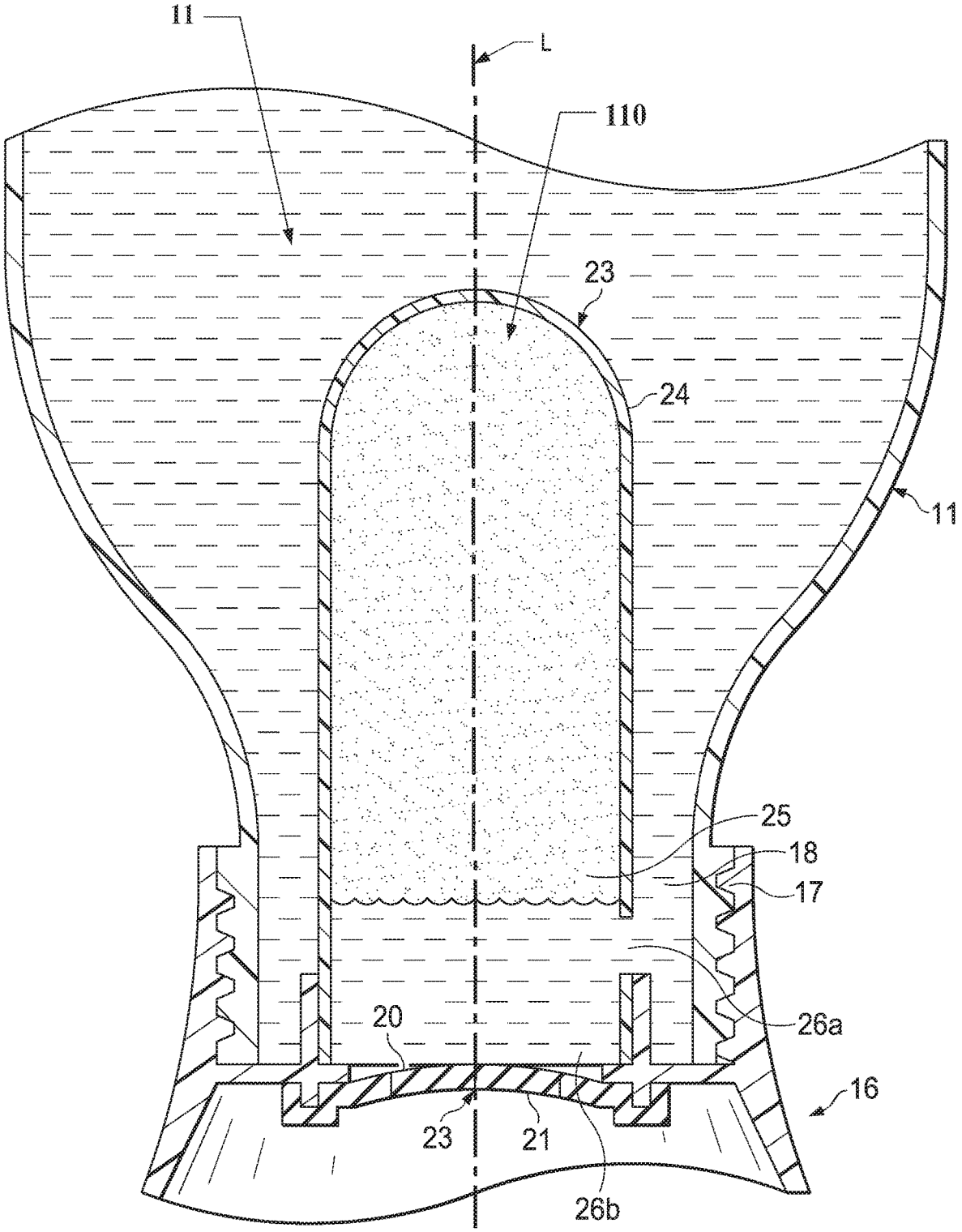
FIG. 9 shows a cross-sectional view of the impact resistance system (23) of the liquid dispenser (15) according to the present invention, prior to the 'impact' and with the compressible substance (110) uncompressed.

As shown in FIG. 9, the housing (24) further comprises a cavity (25). The cavity (25) is a hollow open space inside the housing (24). The cavity (25) is adapted to be partially occupied by a compressible substance (110). Preferably the compressible substance (110) allows pressure equilibration between the valve interior side (20) and the valve exterior side (21) allowing the dispensing orifice (23) to be/remain reactably closeable. In other words, the compressible substance (110) is to remain uncompressed, prior to "impact" of the inverted container (11), at pressure sufficient to allow the valve (19) to remain closed and retain the liquid inside the inverted container (11). The cavity (25) is also partially occupied by the liquid prior to "impact".

Preferably, the compressible substance (110) is selected from a gas, a foam, a soft matter such as for example a sponge or a balloon, other viscoelastic substance (e.g., polysiloxanes), or a piston, preferably a gas, more preferably air. The Applicants have discovered that in order to maintain the reactably closeable state for the dispensing orifice (23) the preferred ratio of the volume of the gas, preferably air, inside the housing (24) at a steady state to the volume of the inverted container (11) is higher than 0.001, preferably between 0.005 and 0.05, more preferably between 0.01 and 0.02. Without wishing to be bound by theory it is believed that a minimum compression threshold is desired to significantly reduce or prevent leakage risk under expected exposure conditions during transport or usage. This minimum compression threshold directly correlates with the volume of liquid that can be stored inside the inverted container (11).

Inverted Container

It will be evident that the invention can be used with any type of inverted containers. Preferably, the cleaning product is used with the type of inverted container (11) as depicted in FIG. 2. The inverted container (11), insofar as it has been described, may be of any suitable shape or design so long as it can rest on a surface without tipping over. The inverted container (11) can be made of any flexible plastic materials, such as thermoplastic polymers. The flexible materials are compressible enough to deform the inverted container (11) and enable dosing of the liquid yet sufficiently flexible to enable relatively fast shape recovery from the deformation post dosing. Preferably, the flexible plastic materials are polycarbonate, polyethylene (PE), polypropylene (PP), polyvinylchloride (PVC), polyethyleentereftalaat (PET) or the like, or blends or multilayer structures thereof. The flexible plastic material may also container specific moisture or oxygen barrier layers like ethylene vinyl alcohol (EVOH) or the like. The flexible plastic materials may also partially comprise post-consumer recycled materials from bottles, other containers or the like. The inverted container (11) includes an opening (14) (not shown) at the bottom surface so as to enable liquid to pass from the inverted container (2) into the liquid dispenser (1). The opening (12) (not shown) is situated at the bottom surface (12) of the inverted container (11). In other words, the inverted container (11) is dosed from the bottom.

With continued reference to FIG. 2, the inverted container (11) preferably is a squeezable inverted container (11), having at least one, preferably at least two, resiliently deformable sidewall or sidewalls (3). Preferably the inverted container (11) is characterized as having from 5 N to 30 N @ 15 mm sidewalls deflection, preferably 10 N to 25 N @ 15 mm sidewalls deflection, more preferably 18 N, @ 15 mm sidewalls (3) deflection. The inverted container (2) may be grasped by the consumer, and the resiliently deformable sidewall or sidewalls (3) may be squeezed or compressed causing pressure to be applied (also referred to as "applied force") to force the cleaning composition (100) out of the inverted container (11). As a result, the increase of the internal pressure causes the liquid between the inverted container (2) and the valve (19) to be dispensed to the exterior atmosphere through the dispensing orifice (23). When the squeezing or compressing force is removed, the resiliently deformable sidewall or sidewalls (3) are released to vent air from the exterior atmosphere to the cavity (25) to decompress the compressible substance (110) in the space (32) and return the resiliently deformable sidewall or sidewalls (3) to its original shape. Additionally, the venting also refills the cavity (25) of the housing (24) with air from the exterior atmosphere. The vented air moves back into the inverted container (11) via the inlet opening (26*a*) to compensate for the volume of dispensed liquid.

For example, larger sized inverted containers (11) can hold larger liquid volumes. When these larger sized inverted containers (11) are impacted, a higher mass of liquid will move upon a hydraulic hammer and as such a higher increased transient liquid force (F=m*a—second law of Newton, with "F" being force, "m" being mass of moving liquid, and "a" being acceleration speed of moving liquid) and hence pressure will be created into the housing (24). As there is a limit towards how much transient pressure can be absorbed per unit of volume of compressible substance (110), when exceeding that threshold the remaining transient pressure will get translated onto the valve (19), causing leakage accordingly. As such a higher volume of compressible substance (110) is required for higher volumes of liquid into the inverted container (11) to have enough impact resistance buffer to prevent leakage upon an eventual hydraulic hammer exposure.

Test Methods

The following assay set forth must be used in order that the invention described and claimed herein may be more fully understood.

Test Method 1: Leakage Resistance Test

Figure 10:
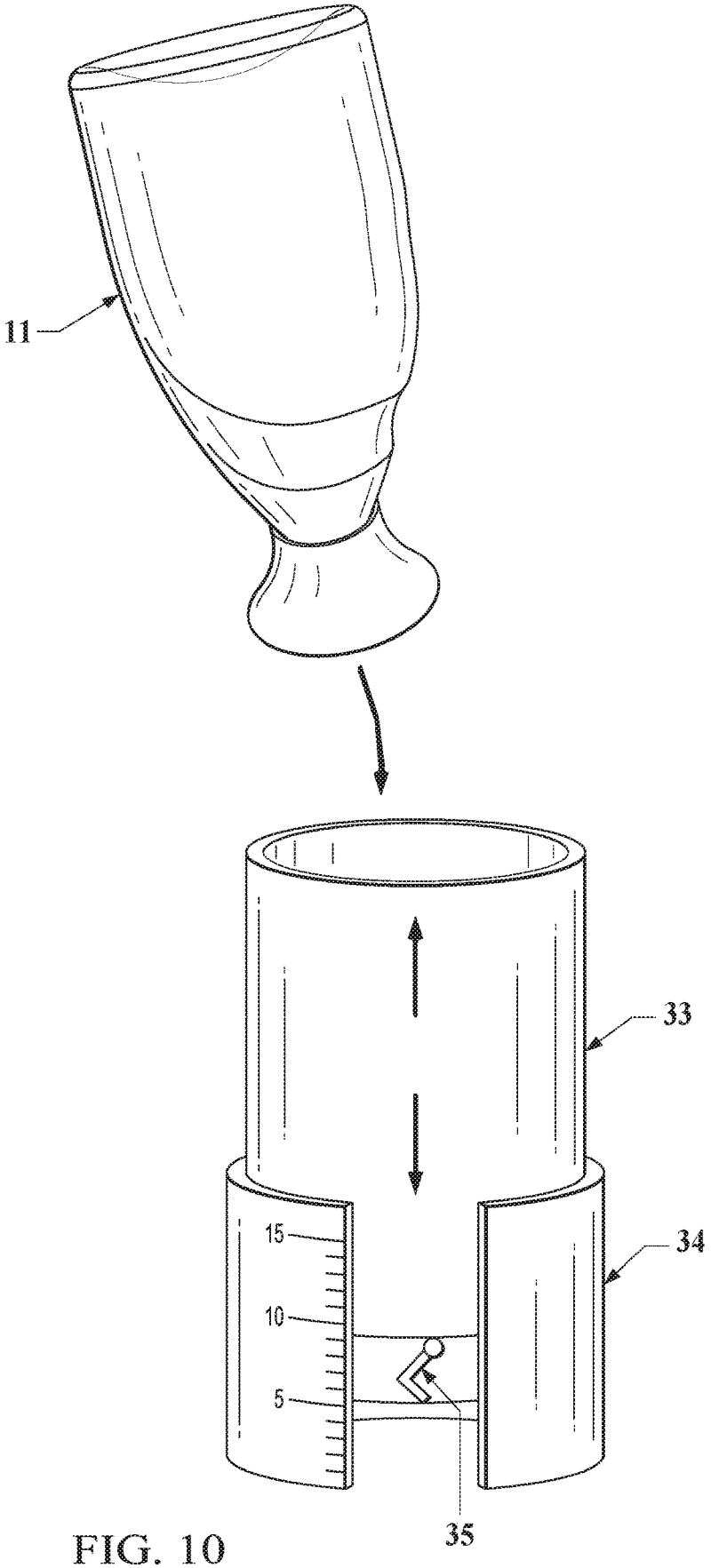
FIG. 10 shows a drop tester apparatus from the Leakage Resistance Test method.

The purpose of the Leakage Resistance Test is to assess the ability of a liquid dispenser to prevent leakage of the liquid from an inverted container during "impact". The impact occurs when the inverted container is dropped, liquid dispenser side down, from a certain height onto a flat surface. The drop is supposed to mimic the resulting transient liquid pressure increases upon impact inside the inverted container. The leakage resistance ability of the liquid dispenser is evaluated through measurement of the volume/weight of the liquid leaked out when dropped from a defined drop height. A lower leaked volume/weight correlates to better leakage resistance ability for the liquid dispenser. The steps for the method are as follows:

1. Use a drop tester apparatus as shown in FIG. 10. The apparatus consists of two top and bottom open ended cylindrical tubes with an approximate diameter of 12 cm, i.e. an outer tube (34) tightly surrounding an inner tube (33) movable in vertical direction into the outer tube (34), the outer tube (34) having a cut out section to enable visual assessment of the relative height of the inner tube (33) within the outer tube (34) through a grading scale applied on the outer tube (34). A removable lever (35) is applied at the bottom of the inner tube (33), allowing an inverted container (2) positioned with its opening downwards within the inner tube (33) to rest on the lever. When the lever (35) is manually removed the inverted container drops down and the amount of leaked liquid after the exposure is weighed. Therefore a piece of paper is positioned on a hard surface at the bottom of the open ended outer container to capture the leaked liquid. The weight of the paper is measured on a balance prior and after the drop test to define the amount of leaked liquid. The height at which the lever (35) was positioned prior to manual removal is measured as the drop height.
2. Fill an inverted container (2) having a defined volume (e.g., 400 mL) with the liquid dishwashing detergent to be tested to a defined fill level (400 ml) within the inverted container. The liquid fill level and the inverted container type including dispenser system and liquid volume are kept constant when cross-comparing different formulations.
3. Assemble a liquid dispenser comprising a valve (Simplicity 21-200 "Simplisqueeze®" valve available from Aptar Group, Inc.) with the inverted container (2), as shown in FIG. 4. The liquid dispenser has a frustoconical shaped exterior portion (e.g., bottom diameter 65 mm, top diameter 34 mm and height 30 mm) for resting on the flat surface, and optionally fitted with an internally developed baffle (e.g., diameter 7 mm, 5 ribs emerging from center ball of 4 mm to the outside), an impact resistance system (30) according to the present invention or both. The container to which the liquid dispensing system is connected is a dishwashing detergent container as commercially available in the UK in December 2017 under the Fairy Original (Dark Green) tradename from the Procter & Gamble Company.

4. Set up the drop height (from 2 cm to 15 cm) on the drop tester.
5. Cut a piece of paper approximately 7 cm×7 cm for fitting the opening at the lower end of the outer tube (34).
6. Weigh the piece of paper using a Mettler Toledo PR1203 balance and record its weight.
7. Place the piece of paper under the opening at the lower end of the outer tube (34).
8. Place the assembled liquid dispenser and inverted container (2), liquid dispenser side down, into the inner tube (33) of the drop tester.
9. Pull back the lever (35) in the drop tester in a quick and smooth motion.
10. Remove the tubes and the assembled liquid dispenser and inverted container from the drop tester.
11. Weigh the piece of paper a second time and record the weight. Calculate the weight difference of the paper, and the delta corresponds to the amount of liquid leaked from the liquid dispenser.
12. Repeat steps 5 to 11 four more times for a total of five replicates for each test condition.
13. Average leaked weights per drop height and detergent composition are calculated and reported.

Test Method 2: Liquid Stringing Resistance Test

The purpose of the Liquid Stringing Resistance Test is to assess the ability of a liquid detergent composition to prevent/reduce forming a capillary string at the end of dosing when the manual pressure on the inverted container is released. The liquid stringing profile of comparative and exemplary formulations is assessed by measuring the breakup time of a capillary formed upon extension of a test sample to a certain strain using a HAAKE™ CaBER™ 1 capillary Break-up extensional rheometer (Thermo Scientific). The sample diameter is set to 6 mm, initial sample height to 3 mm, final sample height to 17.27 mm, stretch profile is set to linear and strike time is set on 100 ms.

Test Method 3: Shear Viscosity Test

The shear viscosity of the liquid detergent compositions is measured using a commercially available DHR-1 rotational rheometer from TA instrument. In particularly, we used cone-plate geometry of 40 mm diameter, 2.008° angle with truncation gap of 56 μm. The steady shear is applied to measure the shear viscosity in the range of 0.1-1000 l/s shear-rate at 20° C. and the shear viscosity at 10/s is reported.

EXAMPLE

The following examples are provided to further illustrate the present invention and are not to be construed as limitations of the present invention, as many variations of the present invention are possible without departing from its spirit or scope.

Example 1: Leakage Resistance Profile

The ability of a cleaning product comprising a cleaning composition (100) according to the present invention (Inventive Compositions 1 and 2), added to an inverted container comprising a liquid dispenser comprising a combined silicone valve and baffle system as described in the test method disclosed herein, to substantially reduce or prevent liquid leakage, has been assessed and cross-compared to comparative compositions outside the scope of the present invention (Comparative Compositions 1 and 2) and a marketed formulation (Comparative Composition 3—retailer Lidl 'Geschirr Spül Mittel' Green Tea & Rose dishwashing liquid as commercially available in Germany in November 2017).

The foregoing compositions are produced through standard mixing of the components described in Table 1.

TABLE 1

Inventive and Comparative Compositions

| As 100% active | Inventive Comp. 1 | Inventive Comp. 2 | Comparative Comp. 1 | Comparative Comp. 2 |
|---|---|---|---|---|
| C1213AE0.6S anionic surfactant (Avg. branching: 33, 44%) | 21.5% | 21.5% | 21.5% | 21.5% |
| C1214 dimethyl amine oxide | 7.2% | — | — | — |
| CAP-betaine (Empigen BS/PG3) | — | 7.2% | — | — |
| Alcohol ethoxylate nonionic surfactant (Neodol 91/8) | — | — | 7.2% | — |
| Alkyl polyglucoside nonionic surfactant (Glucopon ® 600) | — | — | — | 7.2% |
| ethanol | 1.9% | 2.1% | — | 2.3% |
| NaCl | 0.7% | 0.7% | 0.7% | 0.7% |
| Na-citrate | 1% | 1% | — | 1% |
| Polypropyleneglycol (MW2000) | 0.55% | 0.75% | — | 0.6% |
| Water + Minor ingredients (perfume, dye, preservatives) | Balance to 100% | Balance to 100% | Balance to 100% | Balance to 100% |
| pH (at 10% composition concentration in demineralized water - with NaOH/HCl trimming) | 9.1 | 9.1 | 9.1 | 9.1 |
| Shear Viscosity (mPa · s - at 10/s @ 20° C.) | 1,100 | 1,131 | 1,000 | 1,125 |

The results of the Leakage Resistance Test are summarized below in Table 2. The results show the amount (g) of leaked liquid composition as a function of drop height for the inventive and comparative compositions.

TABLE 2

Leakage Resistance Results

| Drop Height | Inventive Comp. 1 | Inventive Comp. 2 | Comparative Comp. 1 | Comparative Comp. 2 | Comparative Comp. 3 |
|---|---|---|---|---|---|
| 6 cm | 0 g | 0 g | 0 g | 0 g | 0.10 g |
| 8 cm | 0.01 g | 0 g | 0.04 g | 0.01 g | 0.17 g |
| 10 cm | 0.01 g | 0 g | 0.07 g | 0.04 g | 0.20 g |
| 15 cm | 0.02 g | 0.02 g | 0.14 g | 0.08 g | 0.29 g |

From the results it can be seen that a liquid composition comprising the anionic surfactant and the primary co-surfactant selected from an amphoteric surfactant (Inventive Composition 1) or a zwitterionic surfactant (Inventive Composition 2) within the defined weight ratio according to the invention, has a higher robustness against a hydraulic hammer impact action compared to Comparative Compositions comprising an alternative primary co-surfactant system (Comparative Compositions 1 and 2) or an anionic surfactant and zwitterionic co-surfactant system outside the weight ratio according to the invention (Comparative Composition 3).

Example 2: Liquid Stringing Profile

The ability of a cleaning product comprising a cleaning composition (100) according to the present invention (Inventive Compositions 1 and 2) to substantially reduce or prevent liquid stringing has been assessed according to the Liquid Stringing Resistance test method disclosed herein and cross-compared to comparative compositions outside the scope of the present invention (Comparative Compositions 1 and 2) and a marketed prior art formulation (Comparative Composition 3—retailer Lidl 'Geschirr Spill Mittel' Green Tea & Rose dishwashing liquid as commercially available in Germany in November 2017). We also cross-compared these formulations versus a Comparative Composition 3 formulation in which we reduced the initial product viscosity through a single variable addition of 0.2% of polypropyleneglycol MW2000 from 3,820 mPa·s to 1,045 mPa·s (Comparative Composition 4). The reduced viscosity of the Comparative Composition 4 is measured at 20° C. using a Brookfield type DV-E with a spindle 31 at rotation speed 12 RPM.

The results of the Liquid Stringing Resistance Test are summarized below in Table 3. The results show the capillary break-up time (s) of a liquid composition, according to the testing protocol described herein.

TABLE 3

Liquid Stringing Resistance Results

| | Inventive Comp. 1 | Inventive Comp. 2 | Comparative Comp. 1 | Comparative Comp. 2 | Comparative Comp. 3 | Comparative Comp. 4 |
|---|---|---|---|---|---|---|
| Break-up time | 0.5 s | 0.5 s | 0.4 s | 0.4 s | 1.2 s | 0.4 s |

From the results it can be seen that the liquid stringing profile of a liquid detergent composition is dominantly determined by the finished product viscosity, i.e., Comparative Composition 3 at increased finished product viscosity compared to other inventive and comparative product compositions tested (i.e., 3,820 mPa·s vs ca. 1,100 mPa·s) showing a significantly lengthened capillary break-up time. As such decreased product viscosities are desired to prevent/reduce liquid stringing. As the leakage risk (static and upon impact) increases at decreased product viscosities, formulating a surfactant system according to the invention is highly preferred to deliver both the desired leakage and stringing reduction/prevention profile.

All percentages and ratios herein are calculated by weight unless otherwise indicated. All percentages and ratios are calculated based on the total composition unless otherwise indicated.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cleaning product comprising: an inverted container assembly and a liquid hand dishwashing cleaning composition contained in the inverted container assembly, wherein:

the inverted container assembly comprises an inverted container having a bottom surface and a top surface located away from the bottom surface, the bottom surface having an opening; and a liquid dispenser attached to the bottom surface of the inverted container, wherein:

a) the cleaning composition comprises from about 1% to about 60% by weight of the total composition of a surfactant system, wherein the surfactant system comprises:

i) an anionic surfactant; and ii) a primary co-surfactant system, wherein the primary co-surfactant system is selected from the group consisting of amphoteric surfactant, zwitterionic surfactant and mixtures thereof;

wherein the composition comprises the anionic surfactant and the primary cosurfactant system is in a weight ratio of from about 8:1 to about 1:1; and b) wherein the liquid dispenser comprises a body and a valve, wherein the body comprises a connecting sleeve adaptable for engaging to the inverted container, wherein the connecting sleeve defines an internal discharge conduit, and wherein the valve extends across the internal discharge conduit.

2. The cleaning product according to claim 1, wherein the anionic surfactant is selected from the group consisting of alkyl sulfate, alkyl alkoxy sulfate and mixtures thereof.

3. The cleaning product according to claim 1, wherein the primary co-surfactant is an amphoteric surfactant.

4. The cleaning product according to claim 1 wherein the surfactant system of the composition further comprises from about 0.1% to about 10% by weight of the total composition of a secondary co-surfactant system comprising a non-ionic surfactant, wherein the anionic surfactant and the non-ionic surfactant are in a ratio of from 2:1 to 50:1.

5. The cleaning product according to claim 4, wherein the non-ionic surfactant is an alkyl ethoxylated surfactant comprising from 9 to 15 carbon atoms in its alkyl chain and from 5 to 12 units of ethylene oxide per mole of alcohol.

6. The cleaning product according to claim 3, wherein the amphoteric surfactant is an amine oxide surfactant selected from the group consisting of linear or branched alkyl amine oxide, linear or branched alkyl amidopropyl amine oxide, and mixtures thereof.

7. The cleaning product according to claim 1 wherein the composition has a shear viscosity of from about 10 mPa·s to about 10,000 mPa·s, at about 10/s as measured according to the Shear Viscosity Test Method at about 20° C.

8. The cleaning product according to claim 1 wherein the composition has a pH in the range of from about 5 to about 12 as measured at about 10% dilution in distilled water at about 20° C.

9. The cleaning product according to claim 1 wherein the composition further comprises from about 0.1% to about 1% by weight of the total composition of an amphiphilic alkoxylated polyalkyleneimine, wherein the amphiphilic alkoxylated polyalkyleneimine is an alkoxylated polyethyleneimine polymer comprising a polyethyleneimine backbone having average molecular weight range from about 100 to about 5,000 Daltons.

10. The cleaning product according to claim 1 wherein the composition further comprises from about 0.1% to about 5% by weight of the total composition of at least one ethyleneoxide (EO)-propyleneoxide (PO)-ethyleneoxide (EO) triblock co-polymer of Formula (I):

$$(EO)_x\text{-}(PO)_y\text{-}(EO)_x \quad (I)$$

wherein:

each x is independently on average between about 1 and about 80; and y is on average between about 1 and about 60.

11. The cleaning product according to claim 1, wherein the composition comprises: from about 0.05% to about 2%, by weight of the total composition of a salt; from about 1% to about 10% by weight of the total composition of a hydrotrope; and from about 0.01% to about 25% by weight of the total composition of an organic solvent.

12. The cleaning product according to claim 1 wherein the connecting sleeve is adaptable for engaging to an exterior surface proximate the opening of the inverted container and is spaced radially to define the internal discharge conduit for establishing fluid communication with the composition contained in the inverted container.

13. The cleaning product according to claim 12 wherein the valve has an interior side for being contacted by the cleaning composition contained inside the inverted container and an exterior side for being exposed to the exterior atmosphere, wherein the valve defines a dispensing orifice that is reactably openable when the pressure on the valve interior side exceeds the pressure on the valve exterior side, and wherein the liquid dispenser further comprises a baffle located above the interior side of the valve.

14. The cleaning product according to claim 13 wherein the baffle includes an occlusion member supported by at least one support member which accommodates movement of the occlusion member between a closed position occluding composition flow into at least a portion of the discharged conduit when the baffle is subjected to an upstream hydraulic hammer pressure.

15. The cleaning product according to claim 12 wherein the liquid dispenser further comprises an impact resistance system localized upstream of the valve and, if present, the baffle (30), wherein the impact resistance system comprises a housing having a cavity therein and extending longitudinally from the body and radially inwardly from the sleeve, wherein the housing comprises at least one inlet opening that provides a flow path for the composition from the inverted container into the housing and at least one outlet opening that provides a path of egress for the composition from the housing to the exterior atmosphere when the dispensing orifice is opened, wherein the cavity is adapted to be partially occupied by a compressible substance, wherein the compressible substance is selected from a gas, a foam, a sponge or a balloon.

16. The cleaning product according to claim 15 wherein the compressible substance is a gas, the ratio of the volume of the gas, inside the housing at a steady-state to the volume of the inverted container is higher than about 0.001.

17. The cleaning product according to claim 1 wherein the liquid dispenser does not comprise a closing cap.

18. A method of cleaning dishware with the cleaning product according to claim 1, the method comprising the step of squeezing the inverted container to dispense the cleaning composition from the opening on the bottom surface.

* * * * *